US011504981B2

(12) United States Patent
Konishi et al.

(10) Patent No.: US 11,504,981 B2
(45) Date of Patent: Nov. 22, 2022

(54) INK JET PRINTER

(71) Applicant: Roland DG Corporation, Hamamatsu (JP)

(72) Inventors: Misaki Konishi, Hamamatsu (JP); Tsutomu Takenouchi, Hamamatsu (JP); Tetsuya Okuda, Hamamatsu (JP); Takeru Muranaka, Hamamatsu (JP)

(73) Assignee: Roland DG Corporation, Hamamatsu (JP)

( * ) Notice: Subject to any disclaimer, the term of this patent is extended or adjusted under 35 U.S.C. 154(b) by 12 days.

(21) Appl. No.: 17/341,125

(22) Filed: Jun. 7, 2021

(65) Prior Publication Data

US 2021/0379908 A1 Dec. 9, 2021

(30) Foreign Application Priority Data

Jun. 8, 2020 (JP) ..... JP2020-099656
Feb. 26, 2021 (JP) ..... JP2021-029865

(51) Int. Cl.
*B41J 11/02* (2006.01)
*B41J 11/00* (2006.01)

(52) U.S. Cl.
CPC ..... *B41J 11/0021* (2021.01); *B41J 11/02* (2013.01)

(58) Field of Classification Search
CPC ..... B41J 11/00; B41J 11/0035; B41J 11/0045; B41J 11/005; B41J 11/02; B41J 11/06; B41J 11/08; B41J 11/485; B41J 11/50; B41J 11/54; B41J 15/00; B41J 15/08
See application file for complete search history.

(56) References Cited

U.S. PATENT DOCUMENTS

2011/0007119 A1 1/2011 Baba et al.
2013/0258013 A1 10/2013 Koshikawa
2021/0276344 A1* 9/2021 Wada ..... B41J 2/01

FOREIGN PATENT DOCUMENTS

JP H11157289 6/1999
JP H11157289 A * 6/1999
JP 2003-029481 1/2003
JP 2010-069664 4/2010
JP 2011-031600 2/2011
JP 2012-056757 3/2012
(Continued)

OTHER PUBLICATIONS

Sumii, MachineTranslationofJPH11157289A, 1999 (Year: 1999).*

*Primary Examiner* — Scott A Richmond
(74) *Attorney, Agent, or Firm* — Knobbe, Martens, Olson & Bear, LLP

(57) ABSTRACT

A printer includes: a platen configured to allow a rolled first recording medium and a sheet-like second recording medium to be placed thereon; and a guide table detachably provided on a base member and configured to guide movement of the second recording medium. The platen includes a first platen on which the first recording medium and the second recording medium are placed, and a second platen disposed ahead of the first platen, including an upper surface tilted obliquely downward from the rear toward the front, and configured to guide movement of the first recording medium. The guide table includes a placement portion including a flat upper surface which is located below the first platen and above a portion of the second platen and on which the second recording medium is placed.

17 Claims, 27 Drawing Sheets

(56) References Cited

FOREIGN PATENT DOCUMENTS

| | | | | | |
|---|---|---|---|---|---|
| JP | 2013-208744 | | 10/2013 | | |
| WO | WO2015/166950 | A1 | 11/2015 | | |
| WO | WO-2015166950 | A1 * | 11/2015 | ..... | B41J 11/50 |

* cited by examiner

INK JET PRINTER

CROSS REFERENCE TO RELATED APPLICATIONS

This application claims the benefit of priority to Japanese Patent Applications Nos. 2020-99656 filed on Jun. 8, 2020 and 2021-29865 filed on Feb. 26, 2021. The entire contents of these applications are hereby incorporated herein by reference.

BACKGROUND OF THE INVENTION

1. Field of the Invention

The present teaching relates to an ink jet printer.

2. Description of the Related Art

An ink jet printer known to date includes a platen on which a recording medium is placed, and ink heads that discharge ink onto the recording medium on the platen. The recording medium can be, for example, a rolled recording medium or a sheet-like recording medium. The rolled recording medium is made of a relatively thin material with low rigidity, and thus, is easily bent. On the other hand, the sheet-like recording medium is made of a relatively thick material with higher rigidity than that of the rolled recording medium, and thus, is not easily bent. International Patent Publication No. 2015/166950 discloses an ink jet printer capable of printing on a plurality of types of recording media.

The printer disclosed in International Patent Publication No. 2015/166950 is capable of smoothly conveying different types of recording media and selectively using these recording media. In conveying the sheet-like recording media, however, a plurality of conveying rollers for conveying the sheet-like recording media are additionally needed so that the configuration of the printer might be complicated with an increase in costs. In addition, the conveying rollers need to be disposed ahead of and behind the platen, and thus, the printer tends to be long in the front-rear direction.

SUMMARY OF THE INVENTION

It is therefore an object of the present teaching to provide an ink jet printer capable of using different types of recording media with a simpler configuration.

An ink jet printer according to the present teaching includes: a base member; a platen disposed on the base member and configured to allow a rolled first recording medium and a sheet-like second recording medium to be placed on the platen; a carriage disposed on the base member, located above the platen, and movable in a main scanning direction; an ink head mounted on the carriage and configured to discharge ink onto the first recording medium and the second recording medium, the first recording medium and the second recording medium being conveyed in a sub-scanning direction orthogonal to the main scanning direction; and a guide table detachably disposed on the base member and configured to guide movement of the second recording medium conveyed from the platen. The platen includes a first platen including a flat upper surface and configured such that the first recording medium and the second recording medium are placed on the first platen, and a second platen disposed at a downstream side of the first platen in the sub-scanning direction, including an upper surface tilted obliquely downward from an upstream side in the sub-scanning direction toward the downstream side, and configured to guide movement of the first recording medium. The guide table includes a placement portion located below the first platen and above a part of the second platen and including a flat upper surface on which the second recording medium is to be placed.

According to the ink jet printer of the present teaching, in the case of using the sheet-like second recording medium, the guide table is attached to the base member so that movement of the second recording medium conveyed from the first platen is guided by the guide table. The guide table includes the placement portion located below the first platen and above apart of the second platen. Since the placement portion has a flat upper surface, the relatively thick second recording medium can be conveyed without being bent significantly. In the case of using the rolled first recording medium, the guide table is detached from the base member so that movement of the first recording medium conveyed from the first platen is guided by the second platen. Although the upper surface of the second platen tilts obliquely downward from the upstream side toward the downstream side in the sub-scanning direction, since the relatively thin first recording medium is easily bent, the first recording medium can be conveyed along the upper surface of the second platen. As described above, by attaching the guide table to the base member, the second recording medium can be conveyed by using a configuration for conveying the first recording medium. That is, the first recording medium and the second recording medium can be selectively used by attaching and detaching the guide table to/from the base member.

The present teaching can provide an ink jet printer capable of using different types of recording media with a simpler configuration.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
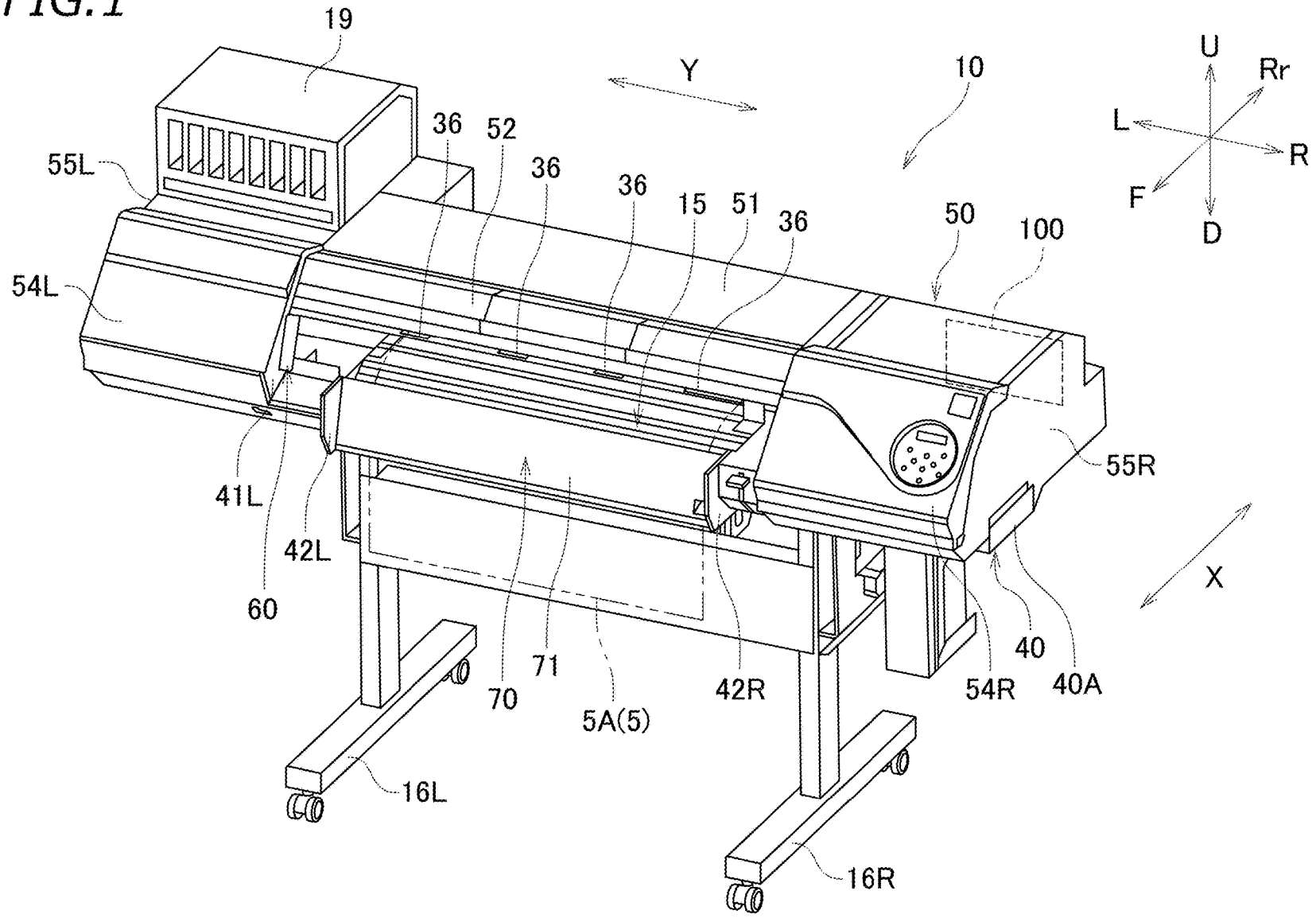
FIG. 1 is a perspective view illustrating a printer according to one preferred embodiment.

An ink jet printer (hereinafter referred to as a "printer") according to a preferred embodiment of the present teaching will be described hereinafter with reference to the drawings. The preferred embodiment described herein is, of course, not intended to particularly limit the present teaching. Members and parts having the same functions are denoted by the same reference numerals, and description for the same members and parts will not be repeated or will be simplified as appropriate.

FIG. 1 is a perspective view illustrating a printer 10 according to this preferred embodiment. As illustrated in FIG. 1, the printer 10 performs printing on recording media 5. The recording media 5 are, for example, recording sheets. The recording media 5 are not limited to the recording sheets. Examples of the recording media 5 include, as well as papers such as plain paper and printing paper for ink jet, a medium made of a resin material such as polyvinyl chloride (PVC) or polyester, a metal plate made of, for example, aluminium or iron, a glass plate, a wood plate, or a corrugated cardboard, for example. Among the recording media 5, a recording medium wound in a roll shape (a roll-shaped recording medium) will be referred to as a first recording medium 5A. The first recording medium 5A has a relatively small thickness. The first recording medium 5A has relatively low rigidity and is easily bent. Among the recording media 5, a recording medium having a sheet shape (sheet-like recording medium) will be referred to as a second recording medium 5B. The second recording medium 5B has a relatively large thickness. The second recording medium 5B is of a standard size. The second recording medium 5B has relatively high rigidity and is not easily bent. In the following description, the first recording medium 5A and the second recording medium 5B will be collectively referred to as recording media 5 in some cases.

In the following description, left, right, up, and down respectively refer to left, right, up, and down seen from an operator at the front of the printer 10. The direction toward the operator from the rear of the printer 10 while the operator faces the front of the printer 10 will be referred to as forward, and the direction from the operator toward the rear of the printer 10 will be referred to as rearward. In the drawings, characters F, Rr, L, R, U, and D represent front, rear, left, right, up, and down, respectively. An ink head unit 20 (see FIG. 2) described later is movable leftward and rightward. Supposing the rear side of the printer 10 is an upstream side and the front side of the printer 10 is a downstream side, the recording media 5 are conveyed from the upstream side toward the downstream side. In this preferred embodiment, a direction in which the ink head unit 20 moves will be referred to as a main scanning direction Y, and a direction in which the recording media 5 are conveyed will be referred to as a sub-scanning direction X. The main scanning direction Y herein corresponds to a left-right direction, and the sub-scanning direction X corresponds to the front-rear direction. The main scanning direction Y and the sub-scanning direction X are orthogonal to each other. The main scanning direction Y and the sub-scanning direction X are not specifically limited, and may be appropriately set depending on, for example, the mode of the printer 10.

As illustrated in FIG. 1, the printer 10 includes a base member 40 having a body 40A extending in the main scanning direction Y, a platen 15 on which recording media 5 are placed, a body case 50, a right leg 16R, a left leg 16L, an ink head unit 20 (see FIG. 2), a medium support device 12 (see FIG. 2), and a controller 100. The right leg 16R and the left leg 16L are attached to a lower portion (the body 40A in this preferred embodiment) of the base member 40. The right leg 16R and the left leg 16L support the base member 40. The medium support device 12 supports the rolled first recording medium 5A. The medium support device 12 does not support the sheet-like second recording medium 5B.

As illustrated in FIG. 1, the base member 40 includes the body 40A, a first left side frame 41L, a first right side frame 41R, a second left side frame 42L, and a second right side frame 42R. The first left side frame 41L is disposed at the left of the platen 15 and extends upward from the body 40A. The first right side frame 41R is located at the right of the platen 15 and extends upward from the body 40A. The second left side frame 42L is disposed at the left of the platen 15 and at the right of the first left side frame 41L, and extends in the top-bottom direction. The second left side frame 42L extends upward and forward from the body 40A. The second right side frame 42R is disposed at the right of the platen 15 and at the left of the first right side frame 41R, and extends in the top-bottom direction. The second right side frame 42R extends upward and forward from the body 40A. The second left side frame 42L and the second right side frame 42R are examples of a vertical wall.

Figure 3:
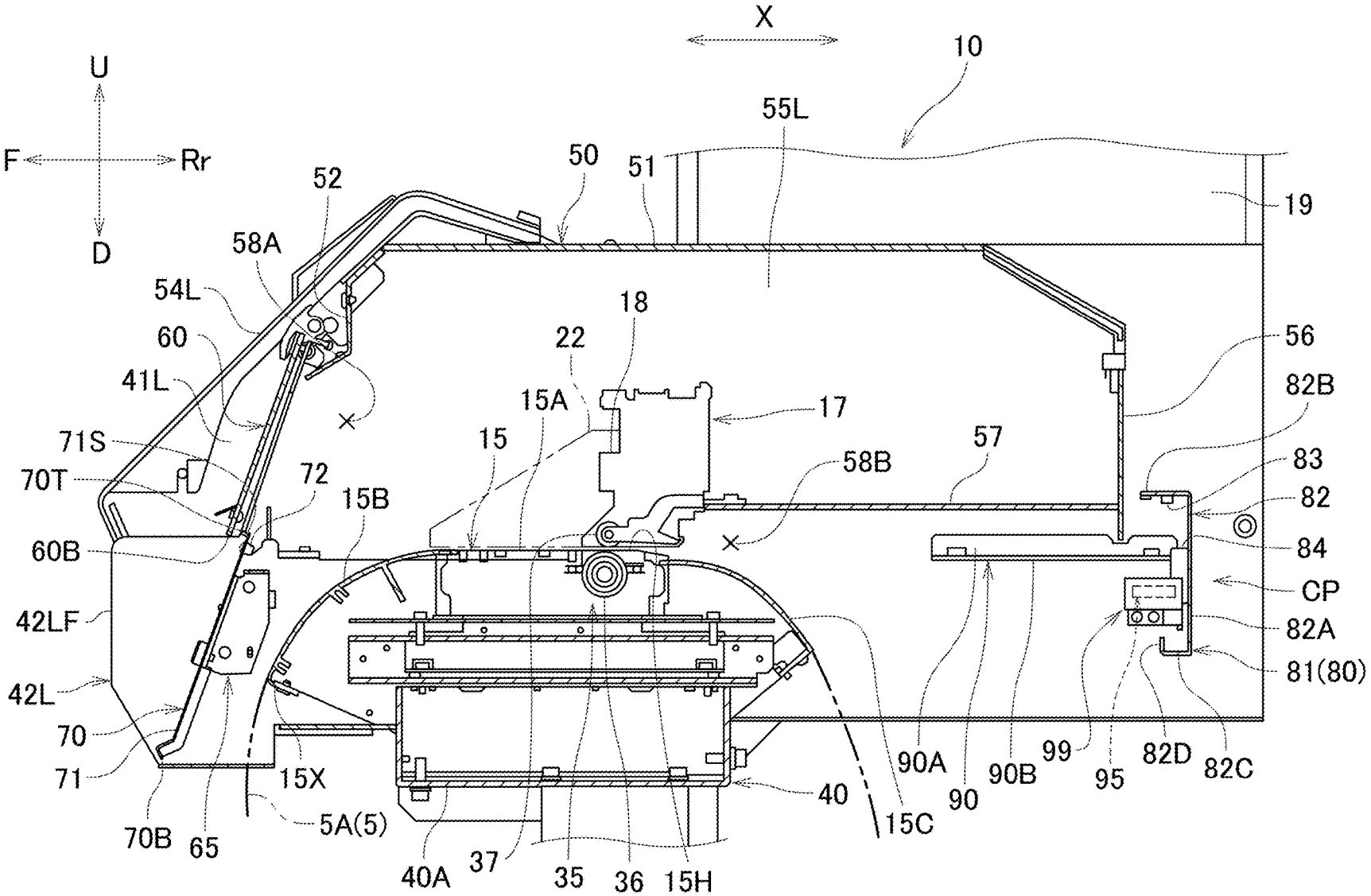
FIG. 3 is a cross-sectional view taken along line A-A in FIG. 2.

As illustrated in FIG. 1, the platen 15 supports the recording media 5 in printing on the recording media 5. The platen 15 is configured to allow the first recording medium 5A and the second recording medium 5B to be placed on the platen 15. The platen 15 extends in the main scanning direction Y. The platen 15 is provided on the base member 40. The platen 15 is provided on a center portion of the base member 40. The platen 15 is supported by the body 40A of the base member 40. The platen 15 is disposed between the second left side frame 42L and the second right side frame 42R while being in contact with the second left side frame 42L and the second right side frame 42R. As illustrated in FIG. 3, the platen 15 includes a first platen 15A including a flat upper surface, a second platen 15B whose upper surface tilts obliquely downward from the rear toward the front (i.e., from the upstream side to the downstream side in the sub-scanning direction X), and a third platen 15C whose upper surface tilts obliquely downward from the front toward the rear (i.e., from the downstream side to the upstream side in the sub-scanning direction X). The first recording medium 5A and the second recording medium 5B are placed on the first platen 15A. The second platen 15B and the third platen 15C guide movement of the first recording medium 5A. The first recording medium 5A moves along the second platen 15B and the third platen 15C. The second recording medium 5B does not move along the second platen 15B and the third platen 15C. The second platen 15B is disposed ahead (i.e., downstream in the sub-scanning direction X) of the first platen 15A. The third platen 15C is disposed behind (i.e., upstream of in the sub-scanning direction X) the first platen 15A.

As illustrated in FIG. 1, the body case 50 is attached to the base member 40. The body case 50 has a box shape. The body case 50 includes an upper wall 51, a front wall 52, a left front cover 54L, a right front cover 54R, a left side wall 55L (see FIG. 3), a right side wall 55R, a rear wall 56 (see FIG. 3), and a lower wall 57 (see FIG. 3). As illustrated in FIG. 3, a first opening 58A and a second opening 58B are formed between the body case 50 and the platen 15. The first opening 58A is formed ahead of a carriage 22 of the ink head unit 20 described later. The second opening 58B is formed behind the carriage 22. The first opening 58A and the second opening 58B communicate with each other. The first opening 58A is an example of an opening.

As illustrated in FIG. 1, the upper wall 51 extends in the main scanning direction Y. The upper wall 51 is located above the base member 40. The upper wall 51 is disposed above the ink head unit 20. The front wall 52 extends forward and obliquely downward from the front end of the upper wall 51. The front wall 52 extends in the main scanning direction Y. The front wall 52 is located between the left front cover 54L and the right front cover 54R. As illustrated in FIG. 3, the first opening 58A is formed between the front wall 52 and the second platen 15B, for example.

The left side wall 55L extends upward from the left end of the body 40A of the base member 40. The left side wall 55L connects the left end of the upper wall 51, the left end of the left front cover 54L, and the left end of the rear wall 56 to one another. As illustrated in FIG. 1, the right side wall 55R extends upward from the right end of the body 40A of the base member 40. The right side wall 55R connects the right end of the upper wall 51, the right end of the right front cover 54R, and the right end of the rear wall 56 to one another.

Figure 4:
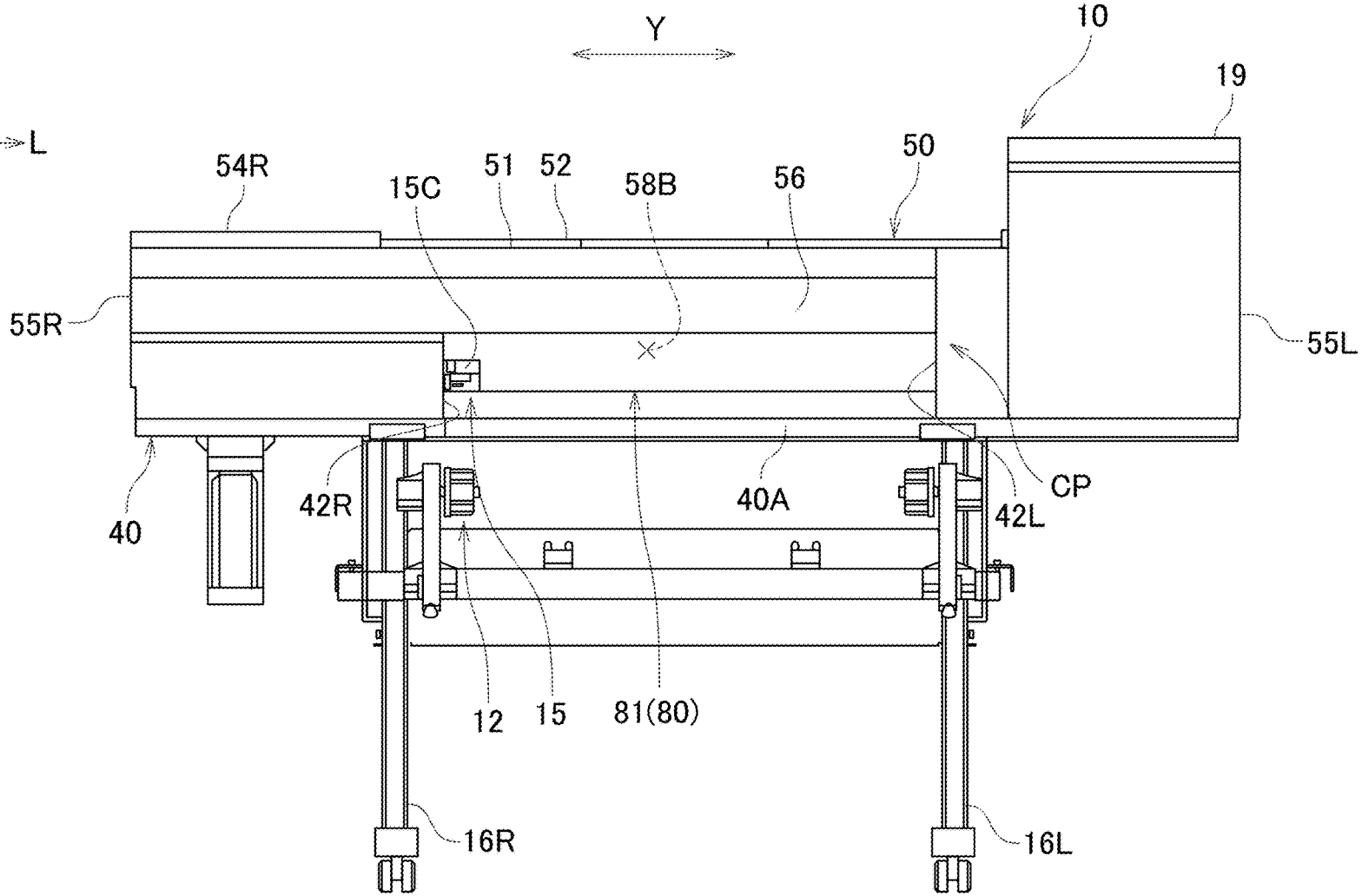
FIG. 4 is a rear view illustrating a printer according to one preferred embodiment

As illustrated in FIG. 4, the rear wall 56 extends downward from the rear end of the upper wall 51. As illustrated in FIG. 3, the lower wall 57 extends forward from a lower portion of the rear wall 56. The lower wall 57 is connected to the second left side frame 42L and the second right side frame 42R of the base member 40 (see FIG. 6). The lower wall 57 is disposed above the platen 15. The second opening 58B is formed between the lower wall 57 and the third platen 15C, for example.

As illustrated in FIG. 1, the left front cover 54L extends forward and obliquely downward from the front end of a left portion of the upper wall 51. The left front cover 54L is configured to be opened and closed around the front end of the upper wall 51. The left front cover 54L is disposed at the left of the platen 15. The right front cover 54R extends forward and obliquely downward from the front end of a right portion of the upper wall 51. The right front cover 54R is configured to be opened and closed around the front end of the upper wall 51. The right front cover 54R is disposed at the right of the platen 15.

Figure 2:
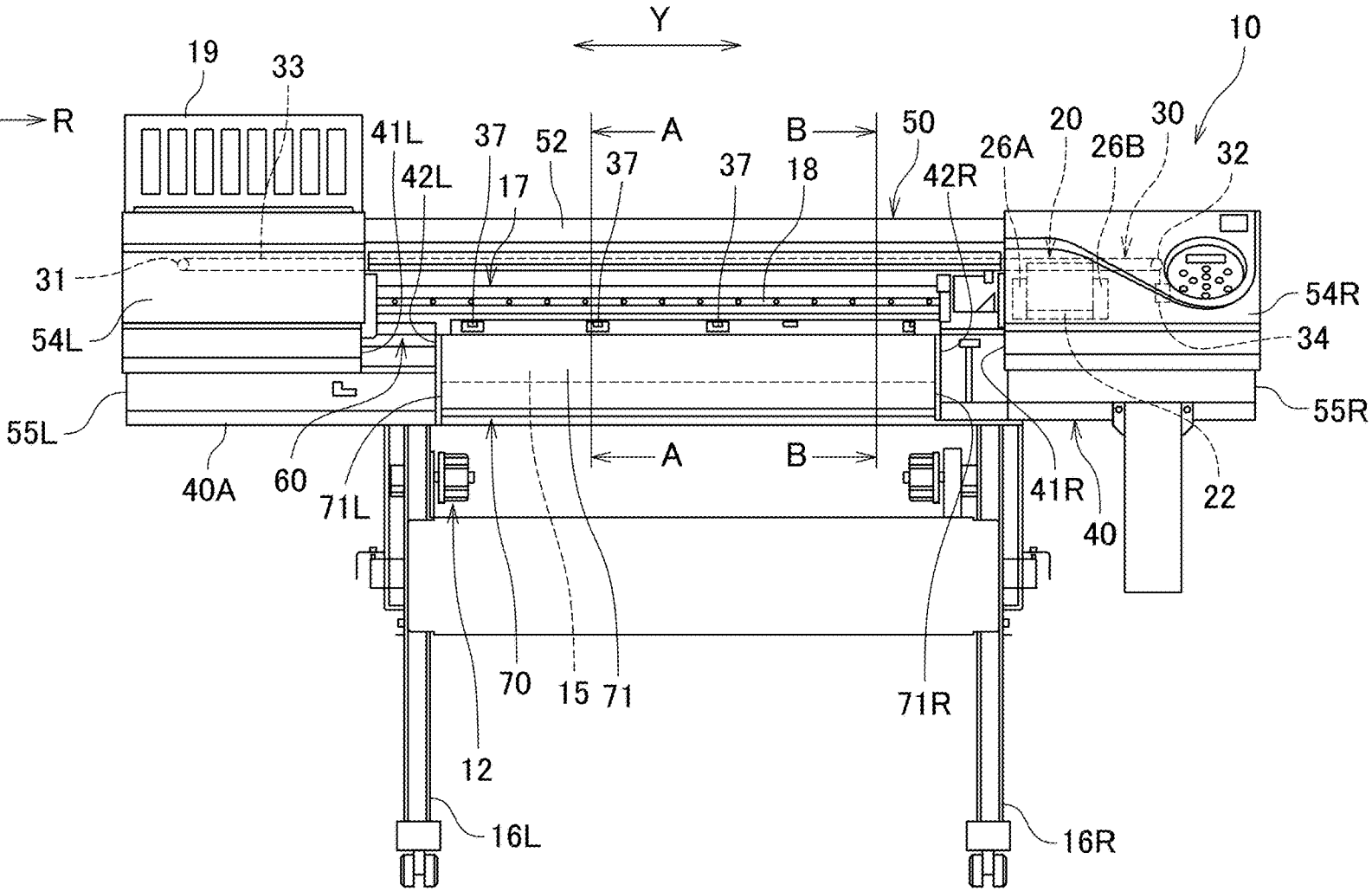
FIG. 2 is a front view illustrating a printer according to one preferred embodiment.

As illustrated in FIG. 2, the printer 10 includes a center wall 17 extending in the main scanning direction Y and the top-bottom direction. The center wall 17 is supported by the base member 40. The center wall 17 is disposed above the platen 15. A gap 15H (see FIG. 3) through which the recording media 5 can pass is formed between the center wall 17 and the platen 15. The center wall 17 is housed in the body case 50.

As illustrated in FIG. 2, the printer 10 includes a guide rail 18. The guide rail 18 extends in the main scanning direction Y. The guide rail 18 is provided on the center wall 17. The guide rail 18 is disposed above the platen 15.

As illustrated in FIG. 2, the ink head unit 20 is provided on the base member 40. The ink head unit 20 is disposed inside the body case 50. The ink head unit 20 is disposed above the platen 15. The ink head unit 20 includes the carriage 22, a plurality of ink heads 24 (see FIG. 5) mounted on the carriage 22, and ultraviolet radiation (UV) irradiators 26A and 26B. The UV irradiators 26A and 26B are an example of a light irradiator. The carriage 22 is provided on the base member 40. The carriage 22 is disposed above the platen 15. The carriage 22 is engaged with the guide rail 18. The carriage 22 is configured to move along the guide rail 18 in the main scanning direction Y.

As illustrated in FIG. 2, the printer 10 includes a carriage movement mechanism 30. The carriage movement mechanism 30 moves the carriage 22 in the main scanning direction Y relative to the recording media 5 placed on the platen 15. The carriage movement mechanism 30 is not limited to a specific configuration. The carriage movement mechanism 30 includes a first pulley 31, a second pulley 32, an endless belt 33, and a carriage motor 34. The first pulley 31 is disposed at the left side of the guide rail 18. The second pulley 32 is disposed at the right side of the guide rail 18. The belt 33 is wound around the first pulley 31 and the second pulley 32. The belt 33 is fixed to an upper portion of the rear surface of the carriage 22. The carriage motor 34 is connected to the second pulley 32. The carriage motor 34 may be connected to the first pulley 31. In this preferred embodiment, the carriage motor 34 is driven to rotate the second pulley 32 so that the belt 33 thereby travels between the first pulley 31 and the second pulley 32. Accordingly, the carriage 22 moves in the main scanning direction Y.

Figure 5:
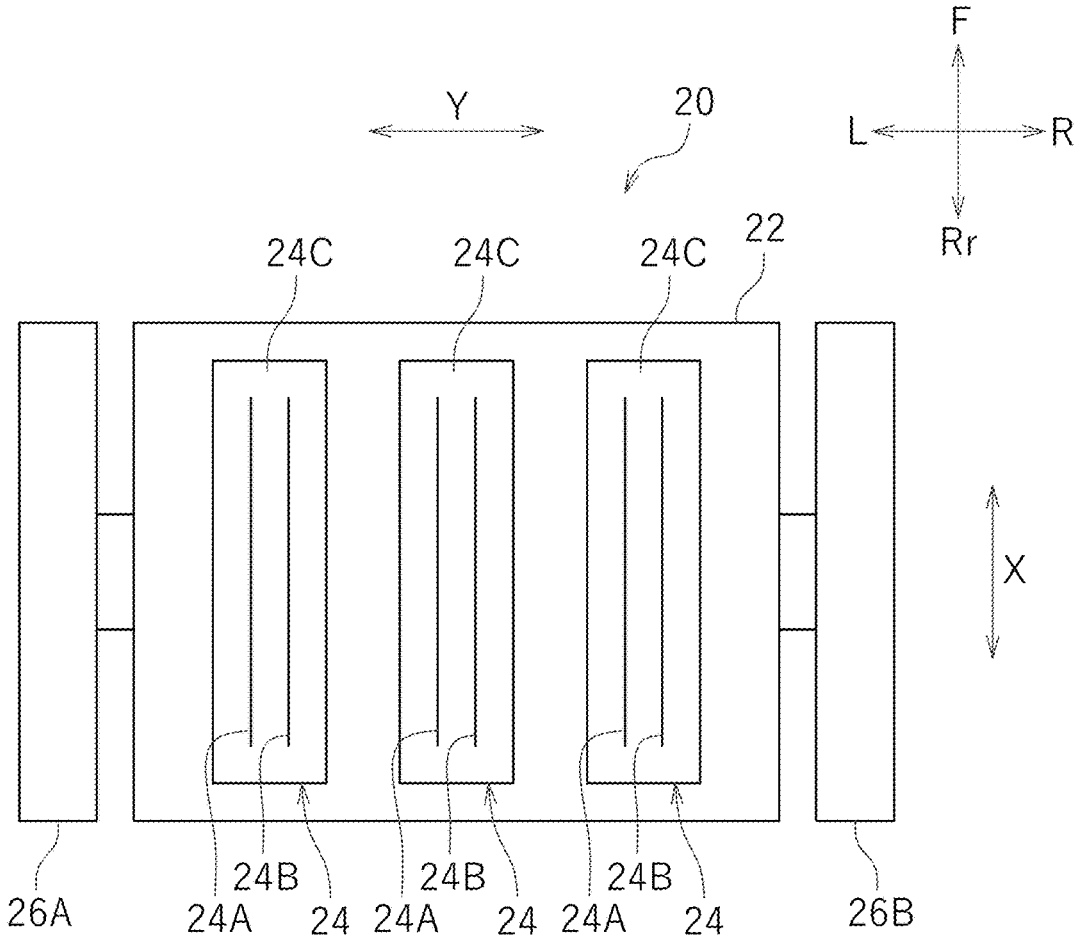
FIG. 5 is a bottom view illustrating an ink head unit according to one preferred embodiment.

As illustrated in FIG. 5, each of the ink heads 24 has a shape whose length in the sub-scanning direction X is longer than the length in the main scanning direction Y. The plurality of (three in this preferred embodiment) ink heads 24 have the same shape and the same size. The ink heads 24 include a plurality of first nozzles 24A arranged in the sub-scanning direction X, a plurality of second nozzles 24B arranged in the sub-scanning direction X, and a nozzle surface 24C on which the first nozzles 24A and the second nozzles 24B are formed. The first nozzles 24A and the second nozzles 24B are minute, and thus, the plurality of first nozzles 24A and the plurality of second nozzles 24B are represented as lines in FIG. 5. The first nozzles 24A and the second nozzles 24B of the ink heads 24 discharge photocurable ink onto the recording media 5. In this preferred embodiment, the printer 10 includes three ink heads 24, but the number of ink heads 24 is not limited to three.

As illustrated in FIG. 1, the printer 10 includes a cartridge accommodating part 19 for accommodating ink cartridges. The cartridge accommodating part 19 is provided on the body case 50. The cartridge accommodating part 19 is disposed on the upper wall 51 of the body case 50. The ink heads 24 (see FIG. 5) communicate with ink cartridges (not shown) accommodated in the cartridge accommodating part 19. Each of the ink cartridges stores photocurable ink.

The photocurable ink has a property of being cured when irradiated with light (e.g., UV light). The photocurable ink (e.g., UV curable ink) includes a coloring agent such as a pigment, photopolymerizable monomer, and a photoinitiator-based material, and when necessary, can include other additives such as a photosensitizer, a polymerization inhibitor, a scavenger, an antioxidant, a UV absorbent, a plasticizer, a surfactant, a levelling agent, a thickener, a dispersant, an antifoaming agent, an antiseptic, and a solvent. The photocurable ink can be, for example, process color ink, white ink, gloss ink, or metallic ink. Examples of the process color ink include cyan ink, magenta ink, yellow ink, black ink, light cyan ink, and light magenta ink.

The UV irradiators 26A and 26B apply UV rays toward photocurable ink discharged onto the first recording medium 5A and the second recording medium 5B. Accordingly, ink layers are formed on the first recording medium 5A and the second recording medium 5B. The UV irradiators 26A and 26B are mounted at both sides of the carriage 22 in the main scanning direction Y. The UV irradiators 26A and 26B are located above the platen 15. As illustrated in FIG. 5, the UV irradiator 26A is disposed at the left of the ink heads 24. The UV irradiator 26B is disposed at the right of the ink heads 24.

As illustrated in FIG. 3, the printer 10 includes a medium movement mechanism 35. The medium movement mechanism 35 moves the recording media 5 placed on the platen 15 in the sub-scanning direction X relative to the ink head unit 20. The medium movement mechanism 35 moves the recording media 5 placed on the platen 15 in the sub-scanning direction X. More specifically, the medium movement mechanism 35 conveys the first recording medium 5A and the second recording medium 5B placed on the first platen 15A in the sub-scanning direction X. The medium movement mechanism 35 includes a plurality of grit rollers 36 (see also FIG. 1) and a plurality of pinching rollers 37 (see also FIG. 2).

As illustrated in FIG. 1, the grit rollers 36 are provided on the platen 15 (the first platen 15A in this preferred embodiment). The grit rollers 36 are embedded in the first platen 15A such that upper portions of the grit rollers 36 are exposed to the outside from the first platen 15A. The grit rollers 36 are arranged in parallel in the main scanning direction Y. The grit rollers 36 are disposed below the pinching rollers 37. The recording media 5 are sandwiched between the grit rollers 36 and the pinching rollers 37. When a feed motor (not shown) connected to the grit rollers 36 is driven to rotate the grit rollers 36 with the recording media 5 sandwiched between the grit rollers 36 and the pinching rollers 37, the recording media 5 are conveyed in the sub-scanning direction X. That is, the grit rollers 36 convey the first recording medium 5A and the second recording medium 5B in the sub-scanning direction X.

As illustrated in FIG. 2, the pinching rollers 37 are disposed above the platen 15. The pinching rollers 37 are disposed below the guide rail 18. The pinching rollers 37 are disposed at positions facing the grit rollers 36. The pinching rollers 37 press the recording media 5 placed on the platen 15 from above.

As illustrated in FIG. 1, the printer 10 includes a front cover 60. The front cover 60 opens and closes the first opening 58A (see FIG. 3). As illustrated in FIG. 3, while the front cover 60 closes the first opening 58A, the front cover 60 tilts obliquely downward from the rear toward the front. The front cover 60 is provided on the base member 40. The front cover 60 is supported by the first left side frame 41L (see FIGS. 1 and 3) and the first right side frame 41R (see FIG. 6) of the base member 40. The front cover 60 is rotatably supported by the first left side frame 41L and the first right side frame 41R. The front cover 60 is disposed ahead of the front wall 52. The front cover 60 is disposed ahead of the first platen 15A. While the front cover 60 closes the first opening 58A, a lower end 60B of the front cover 60 is located ahead of the second platen 15B. The expression "the front cover 60 closes the first opening 58A" includes a case where the front cover 60 closes at least a portion of the first opening 58A and a case where the entire first opening 58A is closed.

As illustrated in FIG. 1, the printer 10 includes a downstream light leakage suppression cover 70 including a plate-shaped member 71 that suppresses leakage of light applied from the UV irradiators 26A and 26B (see FIG. 2) to the outside through a gap between the front cover 60 and the platen 15 (i.e., a portion of the first opening 58A). The downstream light leakage suppression cover 70 (more specifically the plate-shaped member 71) reduces light that is applied from the UV irradiators 26A and 26B (see FIG. 2) and leaks to the outside, to 5% or less (preferably 0%). The downstream light leakage suppression cover 70 is an example of a light leakage suppression cover. The plate-shaped member 71 is an example of a shield. The downstream light leakage suppression cover 70 is configured such that an angle with respect to the front cover 60 is changeable in accordance with the thickness of the recording medium 5 placed on the platen 15, which will be described later. The downstream light leakage suppression cover 70 is attached to the base member 40. The downstream light leakage suppression cover 70 is detachably attached to the second left side frame 42L (see FIGS. 1 and 3) and the second right side frame 42R (see FIG. 6) of the base member 40.

Figure 7:
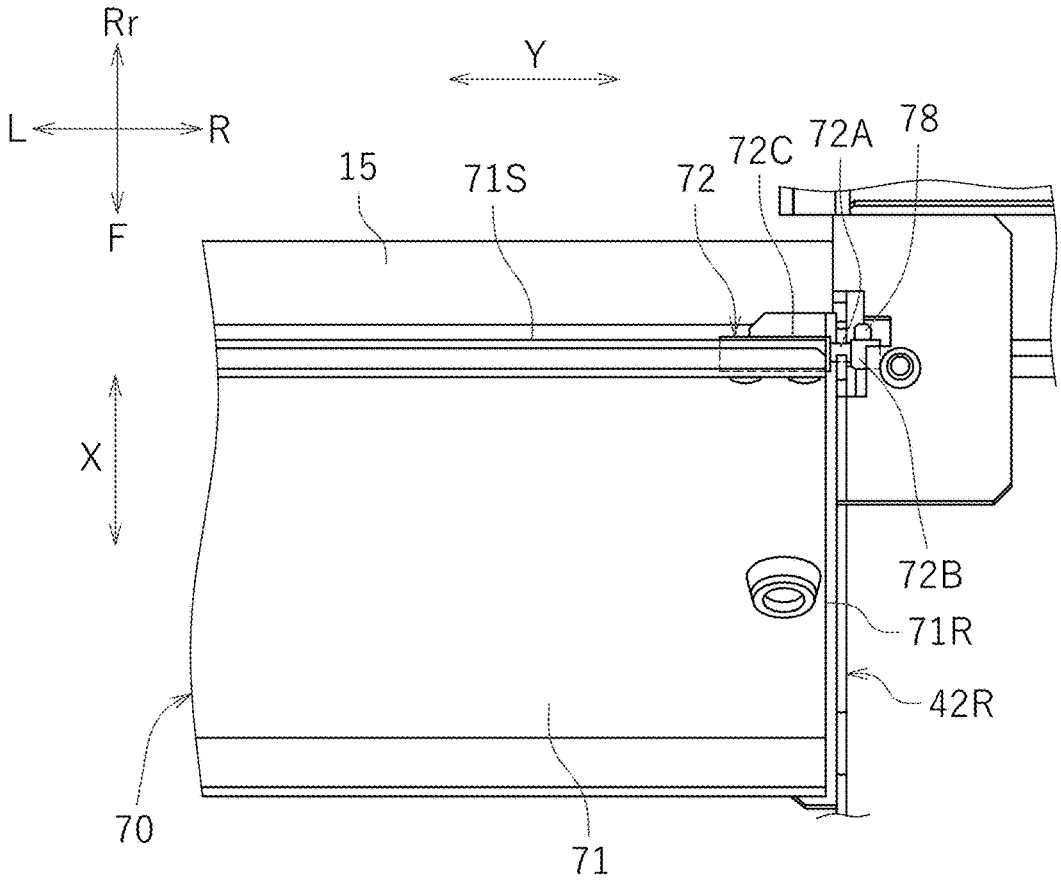
FIG. 7 is a plan view illustrating a state where a downstream light leakage suppression cover according to one preferred embodiment is in contact with a first detection sensor.
Figure 16:
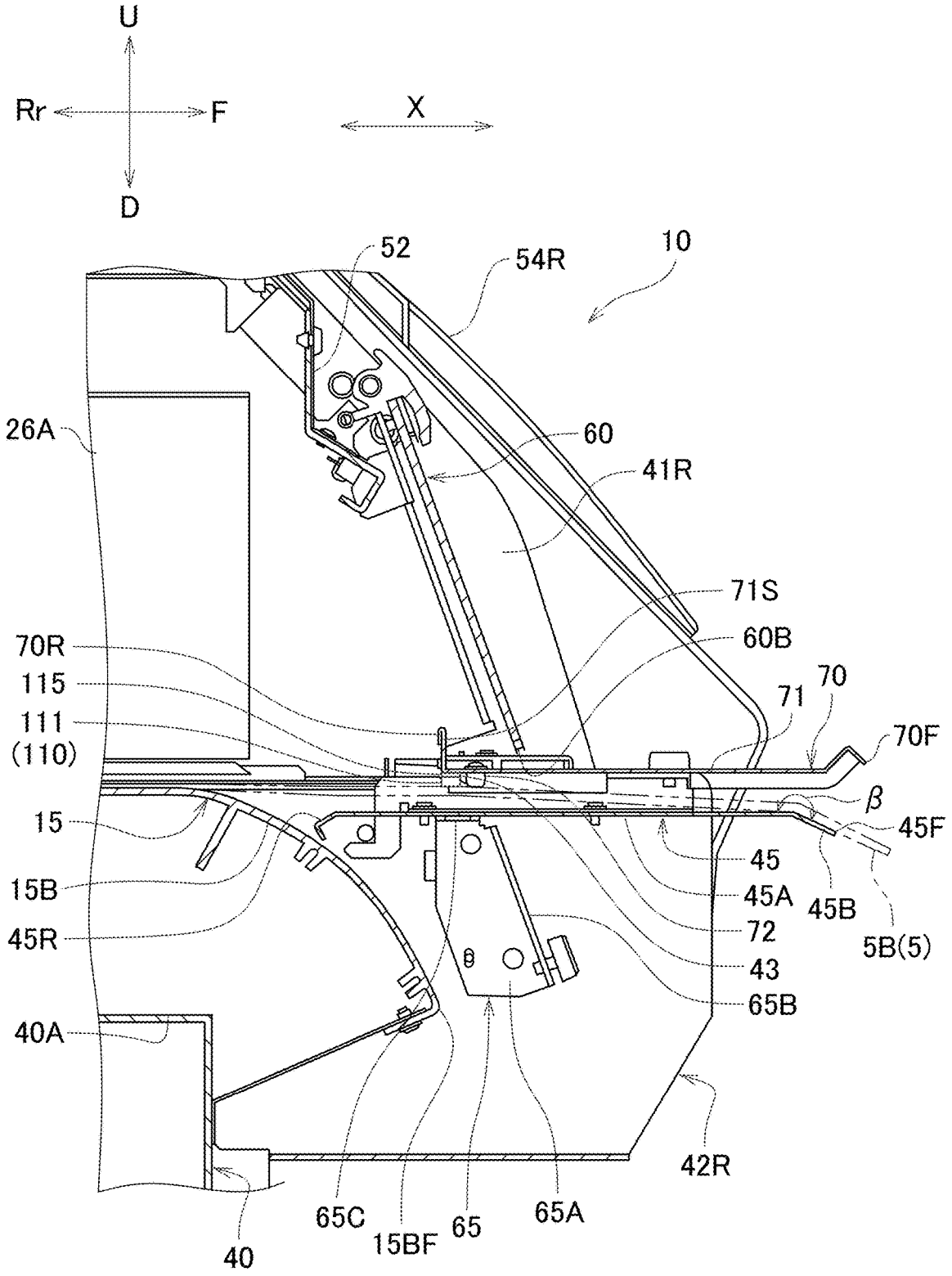
FIG. 16 is a cross-sectional view taken along line D-D in FIG. 14.

As illustrated in FIG. 2, the downstream light leakage suppression cover 70 includes a plate-shaped member 71 extending in the main scanning direction Y, shafts 72 (see FIG. 7) provided at a right end 71R (see FIG. 2) and a left end 71L (see FIG. 2) of the plate-shaped member 71, and a side wall 71S (see FIG. 3) formed by bending a rear end portion of the plate-shaped member 71 upward. The shafts 72 provided at the right end 71R and the left end 71L of the plate-shaped member 71 are symmetric in plan view with respect to a line extending in the sub-scanning direction X, and thus, the following description is directed to the shaft 72 provided at the right end 71R of the plate-shaped member 71. As illustrated in FIG. 7, the shaft 72 extends in the main scanning direction Y. The shafts 72 includes a first portion 72A connected to the plate-shaped member 71, a second portion 72B connected to the first portion 72A and having a shaft diameter larger than that of the first portion 72A, and a third portion 72C fixed to the plate-shaped member 71. In this preferred embodiment, the first portion 72A is indirectly connected to the plate-shaped member 71 through the third portion 72C. The first portion 72A is inserted in a groove 43 (see FIG. 8) formed in the second right side frame 42R. The second portion 72B is a portion to be brought into contact with a pressing plate 78 of a first detection sensor 75 (see FIG. 8) described later. The side wall 71S prevents a finger of an operator or the like from entering the inside of the front cover 60 (i.e., toward the ink head unit 20) through a gap between lower end 60B of the front cover 60 and the downstream light leakage suppression cover 70, and projects perpendicularly to the plate-shaped member 71 to cover the gap. As illustrated in FIG. 16, the side wall 71S projects perpendicularly to the upper surface (i.e., surface on which the second recording medium 5B is placed) of the guide table 45. The side wall 71S projects perpendicularly to the plate-shaped member 71, but the present teaching is not limited to this example. The side wall 71S may tilt obliquely upward with respect to the plate-shaped member 71.

As illustrated in FIGS. 1, 2, and 3, the downstream light leakage suppression cover 70 is attached to the base member 40 at a first angle with respect to the front cover 60 in a case where the recording medium 5 placed on the platen 15 is relatively thin (i.e., a case where printing is performed on the first recording medium 5A). In this preferred embodiment, the downstream light leakage suppression cover 70 is substantially parallel to the front cover 60. As illustrated in FIG. 3, the plate-shaped member 71 of the downstream light leakage suppression cover 70 extends in the top-bottom direction at least below the lower end 60B of the front cover 60. The plate-shaped member 71 of the downstream light leakage suppression cover 70 tilts downward from the rear toward the front (i.e., tilts obliquely downward). An upper end 70T of the plate-shaped member 71 of the downstream light leakage suppression cover 70 is located above and behind the lower end 60B of the front cover 60. The upper end 70T of the plate-shaped member 71 is located above the platen 15. The lower end 70B of the plate-shaped member 71 of the downstream light leakage suppression cover 70 is located below a lower end 15X of the platen 15. The downstream light leakage suppression cover 70 is located ahead of the platen 15. As illustrated in FIG. 2, the plate-shaped member 71 of the downstream light leakage suppression cover 70 overlaps with the platen 15 in front view (i.e., when seen from the downstream side in the sub-scanning direction X).

Figure 13:
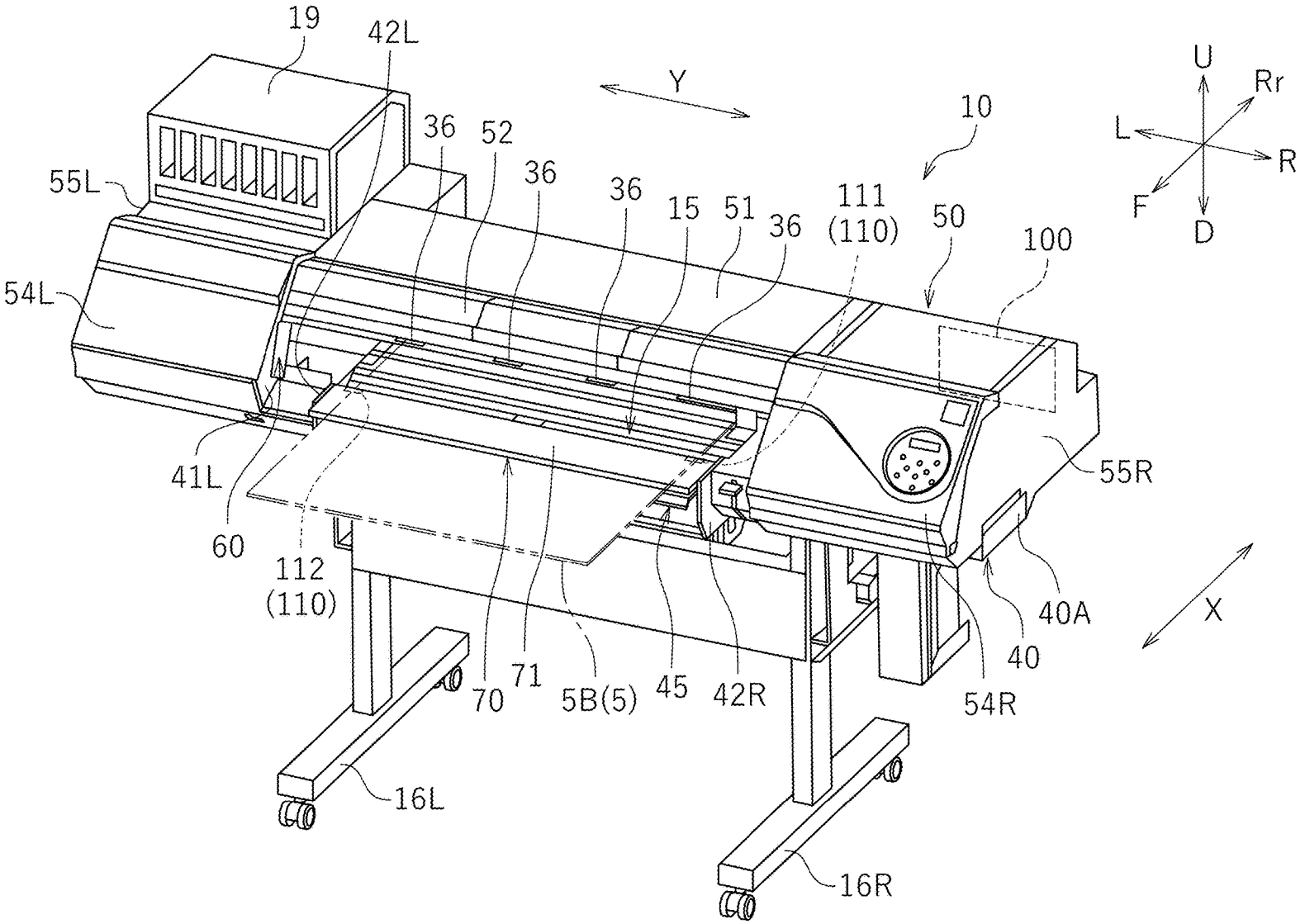
FIG. 13 is a perspective view illustrating a printer according to one preferred embodiment.
Figure 14:
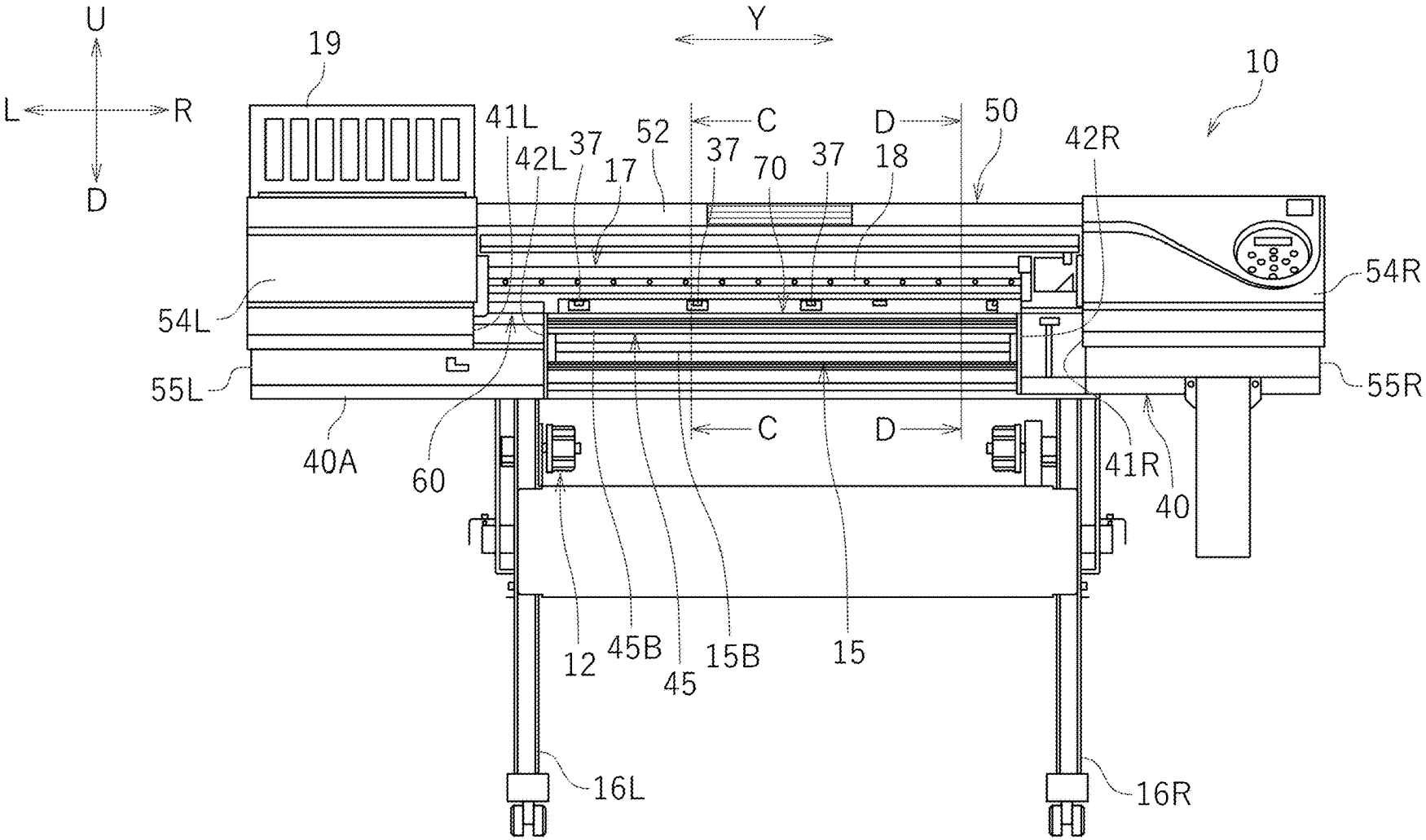
FIG. 14 is a front view illustrating a printer according to one preferred embodiment.
Figure 15:
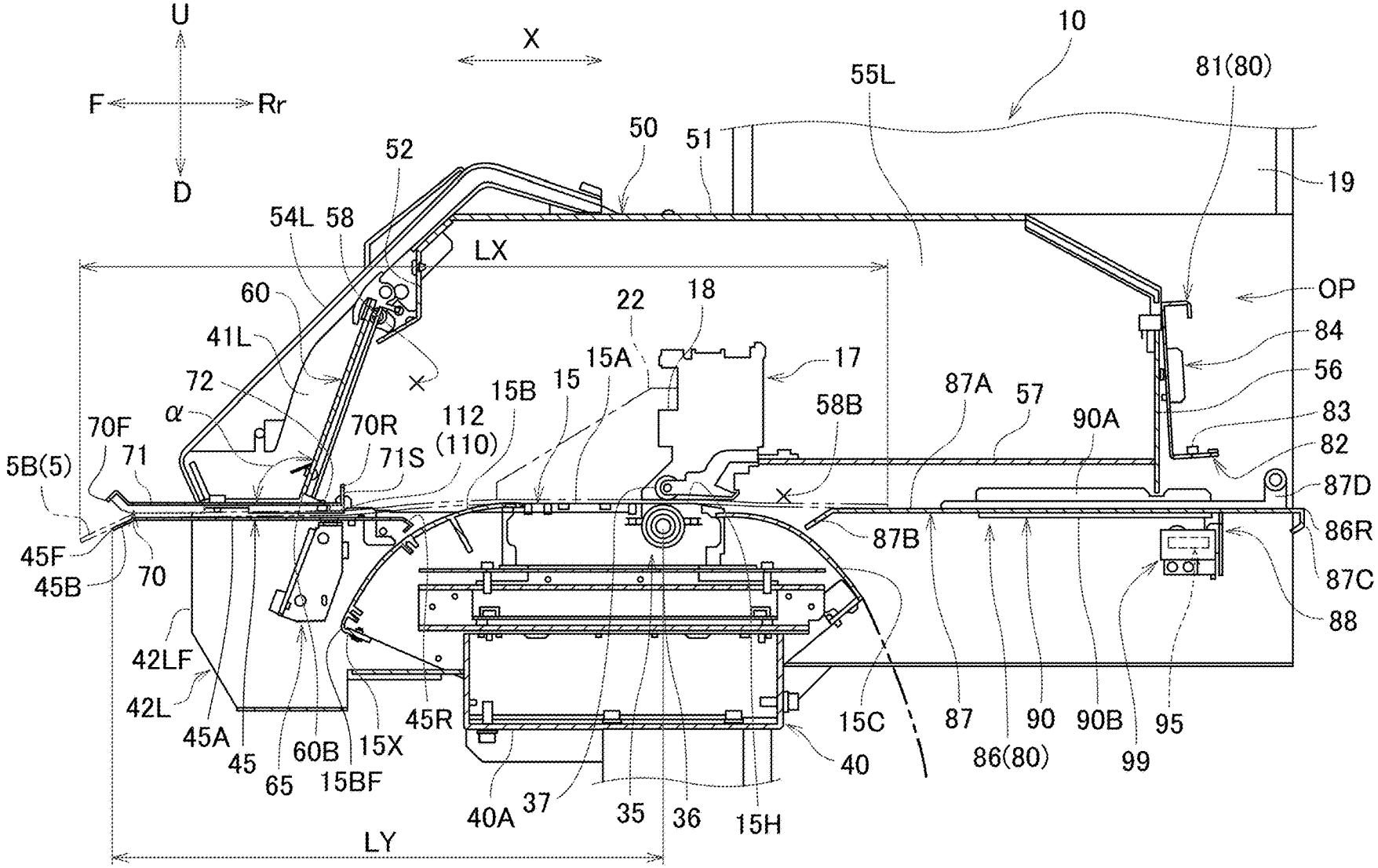
FIG. 15 is a cross-sectional view taken along line C-C in FIG. 14.

As illustrated in FIGS. 13, 14, and 15, the downstream light leakage suppression cover 70 is attached to the base member 40 at a second angle with respect to the front cover 60 in a case where the recording medium 5 placed on the platen 15 is relatively thick (i.e., a case where printing is performed on the second recording medium 5B). In this preferred embodiment, the angle of the downstream light leakage suppression cover 70 with respect to the front cover 60 is a (see FIG. 15). As illustrated in FIG. 15, the plate-shaped member 71 of the downstream light leakage suppression cover 70 extends downstream in the sub-scanning direction X below the lower end 60B of the front cover 60. The plate-shaped member 71 of the downstream light leakage suppression cover 70 is disposed above at least a portion of the platen 15 (the second platen 15B in this preferred embodiment). The plate-shaped member 71 of the downstream light leakage suppression cover 70 extends horizontally. A front end 70F (i.e., a downstream end in the sub-scanning direction X) of the plate-shaped member 71 of the downstream light leakage suppression cover 70 is located ahead of the front cover 60. The front end 70F of the plate-shaped member 71 is located ahead of a front end 42LF of the second left side frame 42L. The downstream light leakage suppression cover 70 is located ahead of the first platen 15A. A rear end 70R (i.e., an upstream end in the sub-scanning direction X, the side wall 71S described above) of the plate-shaped member 71 of the downstream light leakage suppression cover 70 is located behind the lower end 60B of the front cover 60. As illustrated in FIG. 14, the plate-shaped member 71 of the downstream light leakage suppression cover 70 overlaps with a portion of the platen 15 (portion of the second platen 15B in this preferred embodiment) in front view.

Figure 8:
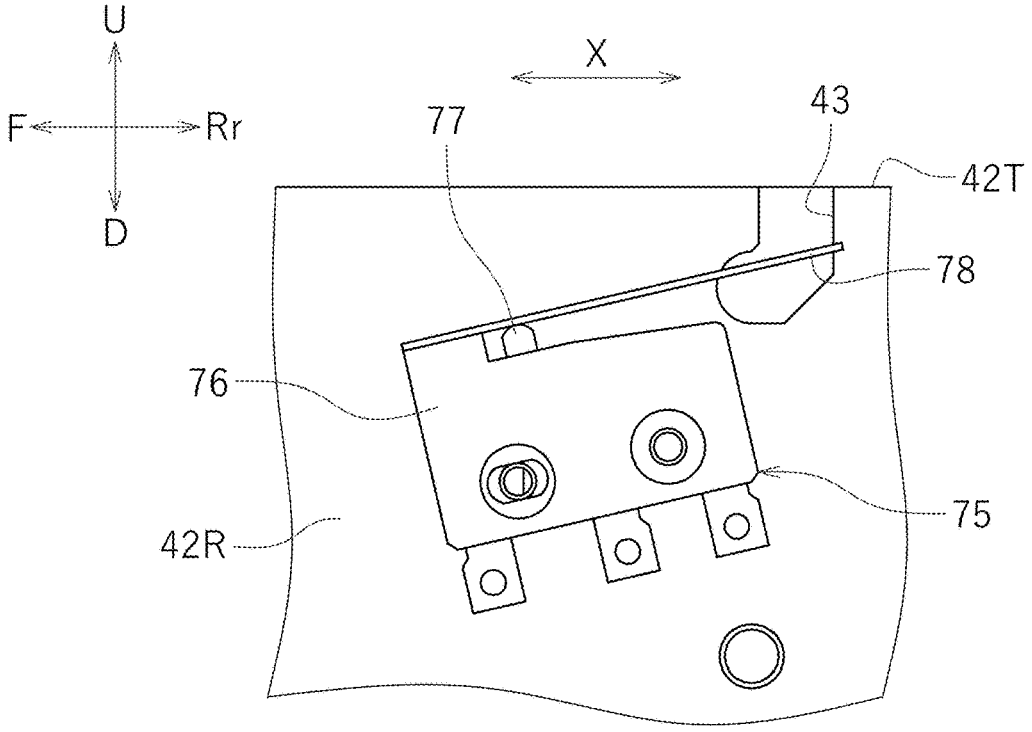
FIG. 8 schematically illustrates a state where a portion of a first detection sensor according to one preferred embodiment overlaps with a groove formed in a vertical wall when seen in a side view.

As illustrated in FIG. 8, the printer 10 includes the first detection sensor 75 that detects whether the downstream light leakage suppression cover 70 is attached or not. The first detection sensor 75 is an example of a detection sensor. The first detection sensor 75 detects that the downstream light leakage suppression cover 70 is attached when the shaft 72 is brought into contact with the first detection sensor 75. The first detection sensor 75 is provided on the second right side frame 42R. The first detection sensor 75 is provided on a surface of the second right side frame 42R in the main scanning direction Y opposite to a surface adjacent to the platen 15. In this preferred embodiment, the first detection sensor 75 is provided on the right surface of the second right side frame 42R. The first detection sensor 75 includes a box-shaped body 76, a switch 77 which is provided on the body 76 and turns on when being pressed and detects that the downstream light leakage suppression cover 70 is attached, and a pressing plate 78 that is provided on the body 76 to be movable upward and downward and presses the switch 77 when being pressed by the second portion 72B of the shafts 72 from above. The pressing plate 78 is a thin plate member that is elastically deformable.

Figure 9:
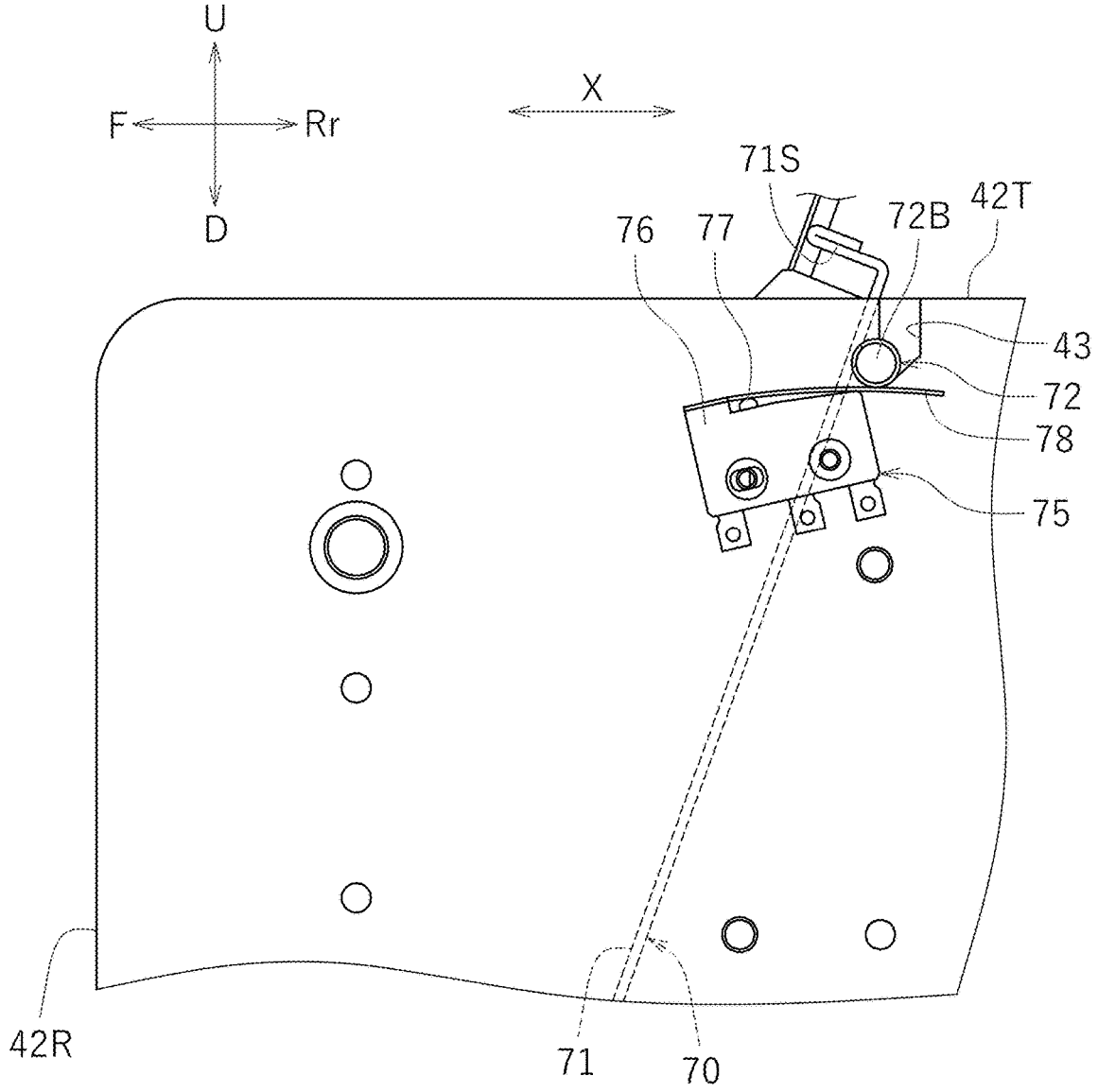
FIG. 9 is a side view illustrating a state where a downstream light leakage suppression cover according to one preferred embodiment is in contact with a first detection sensor.
Figure 10:
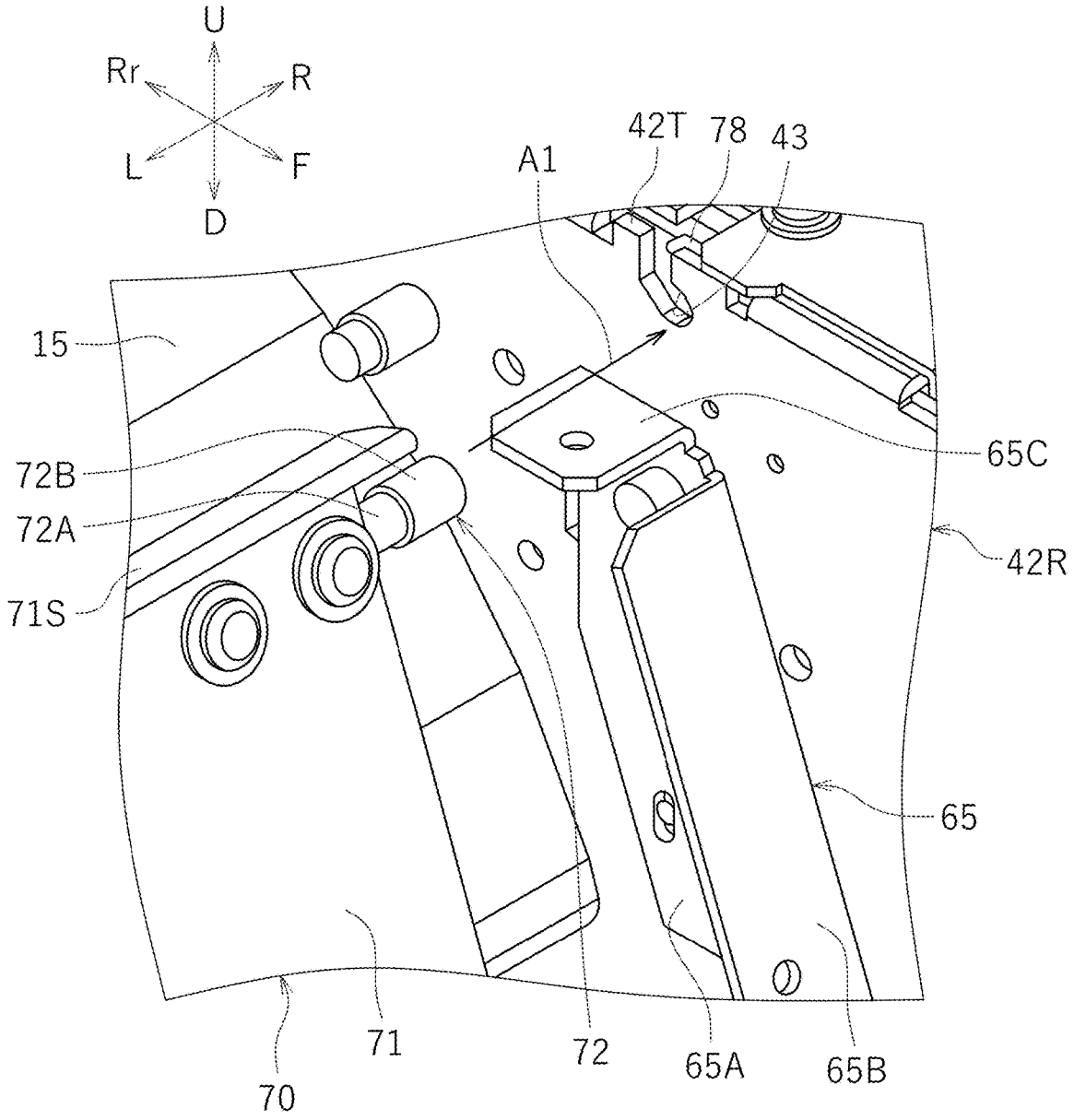
FIG. 10 is a perspective view illustrating a state before a downstream light leakage suppression cover according to one preferred embodiment is attached to a second right side frame.
Figure 11:
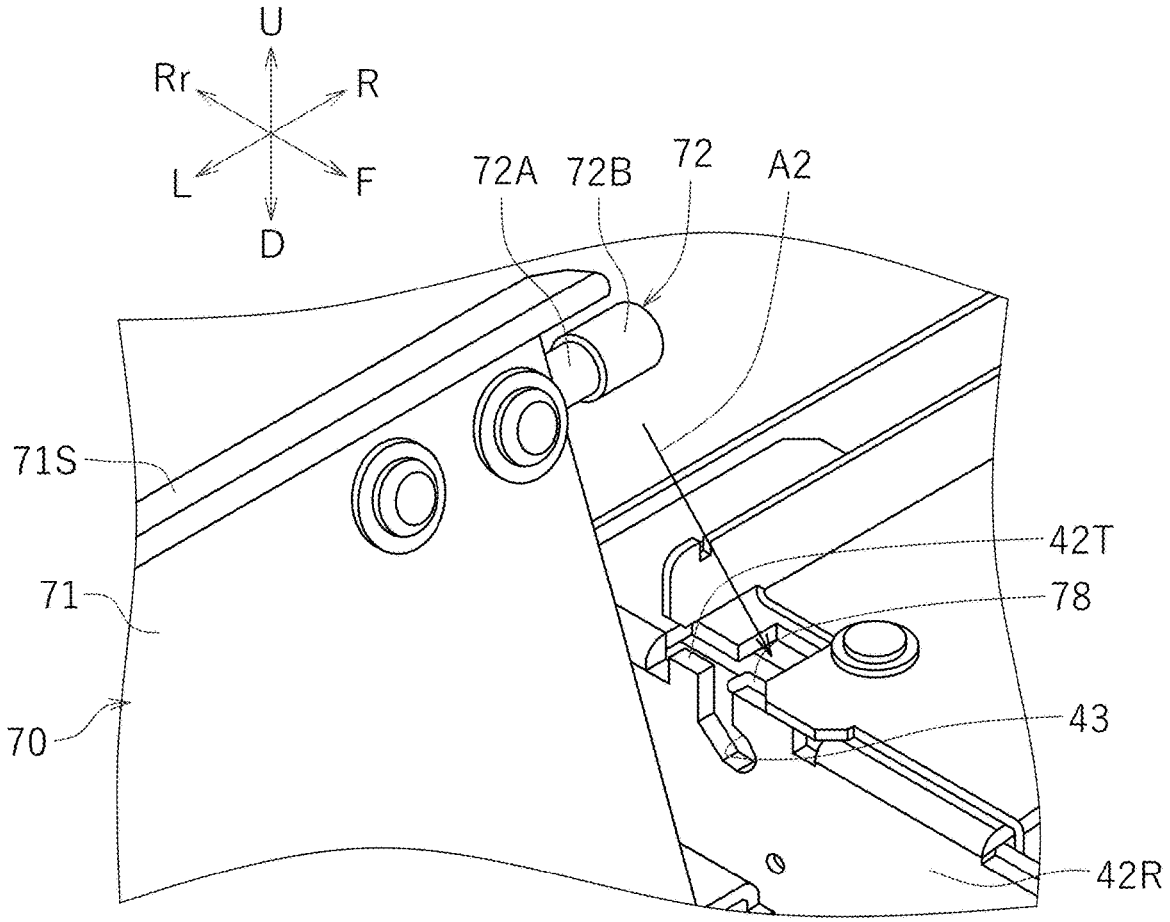
FIG. 11 is a perspective view illustrating a state before a downstream light leakage suppression cover according to one preferred embodiment is attached to a second right side frame.

As illustrated in FIG. 8, the groove 43 is formed in an upper end 42T of the second right side frame 42R. The groove 43 has a size with which the first portion 72A of the shaft 72 can pass through the groove 43. The second right side frame 42R supports the first portion 72A of the shaft 72 in the groove 43. While the shaft 72 is not in contact with the first detection sensor 75, the groove 43 overlaps with a portion of the first detection sensor 75 in side view (i.e., when seen in the main scanning direction Y). In this preferred embodiment, while the second portion 72B of the shaft 72 is not in contact with the pressing plate 78 of the first detection sensor 75, the groove 43 overlaps with the pressing plate 78 in side view. As illustrated in FIG. 9, the second portion 72B of the shaft 72 is larger than the groove 43 in side view. That is, the groove 43 has a size with which the second portion 72B of the shaft 72 cannot pass through the groove 43. Thus, in attaching the downstream light leakage suppression cover 70 to the second right side frame 42R, the shaft 72 does not pass through the groove 43 from the side of the groove 43 as indicated by arrow A1 in FIG. 10. Accordingly, as indicated by arrow A2 in FIG. 11, the shaft 72 is fitted in the groove 43 from above the groove 43 so that the downstream light leakage suppression cover 70 can be thereby attached to the second right side frame 42R.

Figure 6:
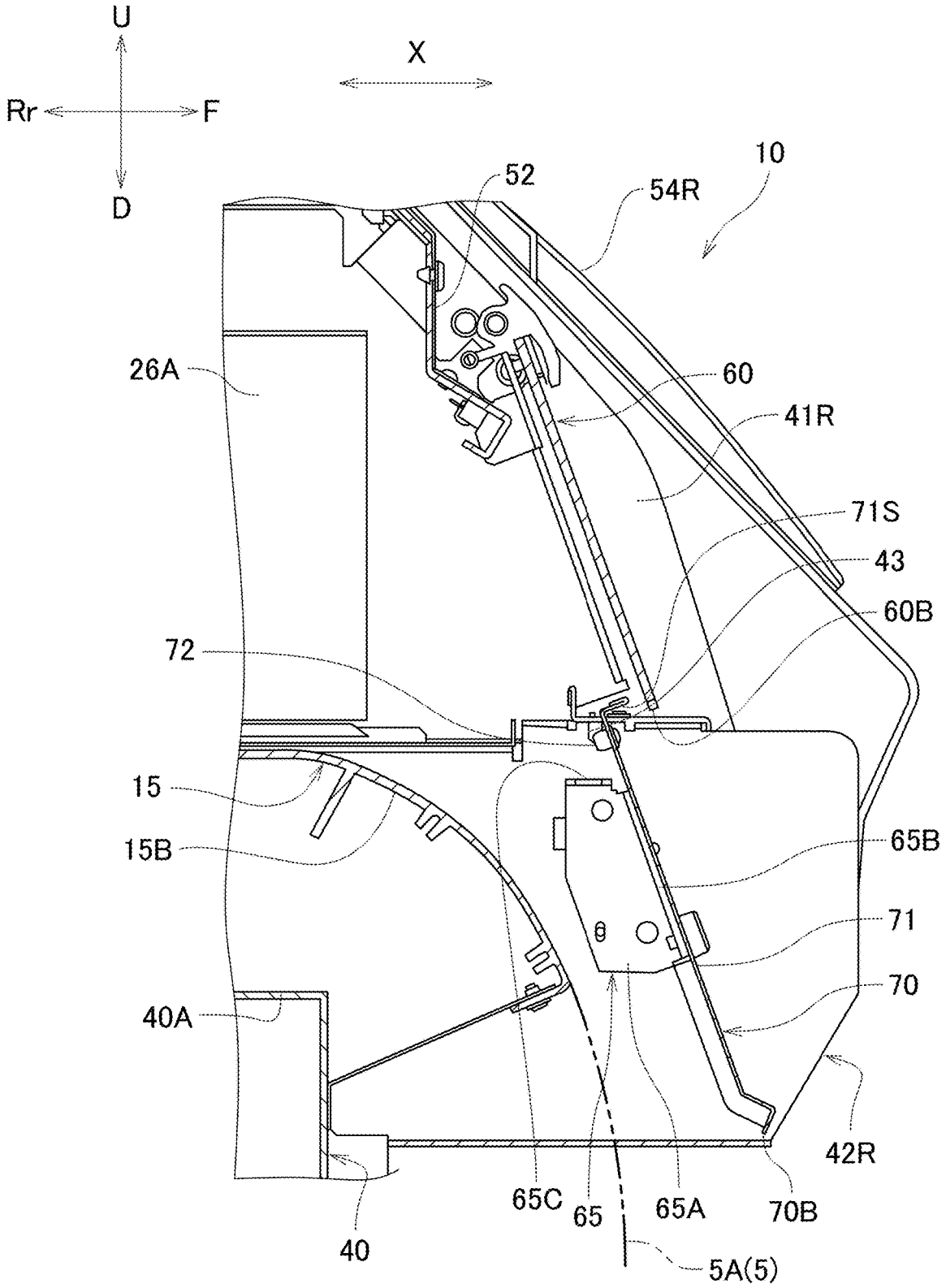
FIG. 6 is a partially enlarged cross-sectional view taken along line B-B in FIG. 2.
Figure 12:
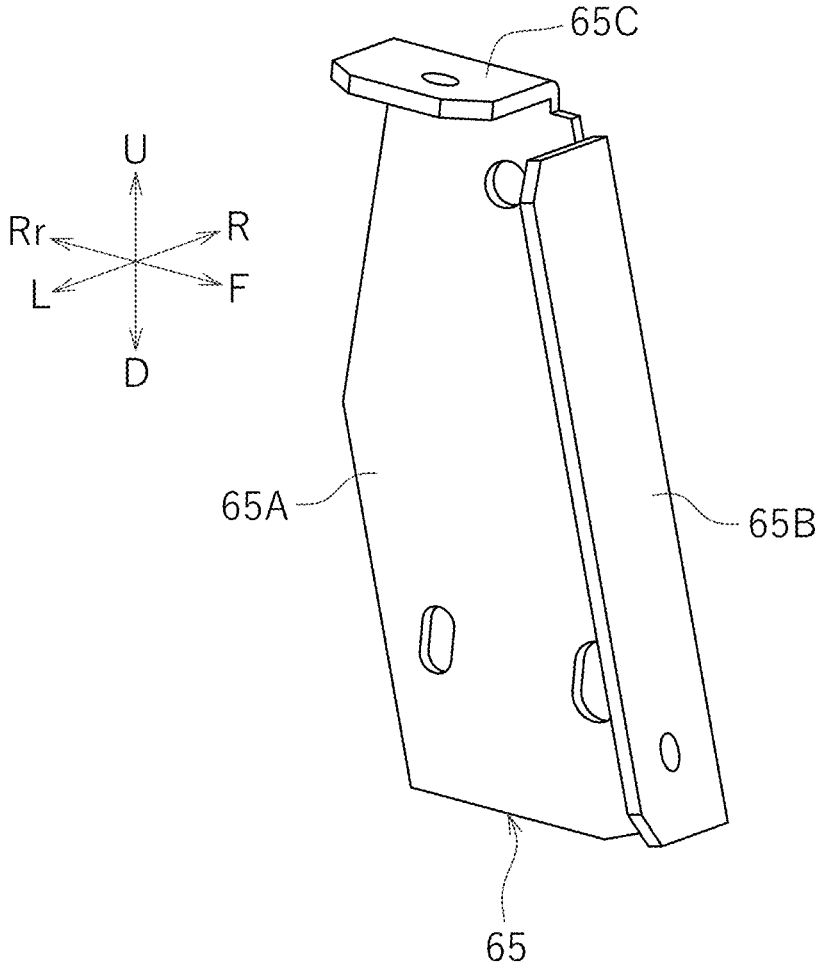
FIG. 12 is a perspective view of a support member according to one preferred embodiment.
Figure 17:
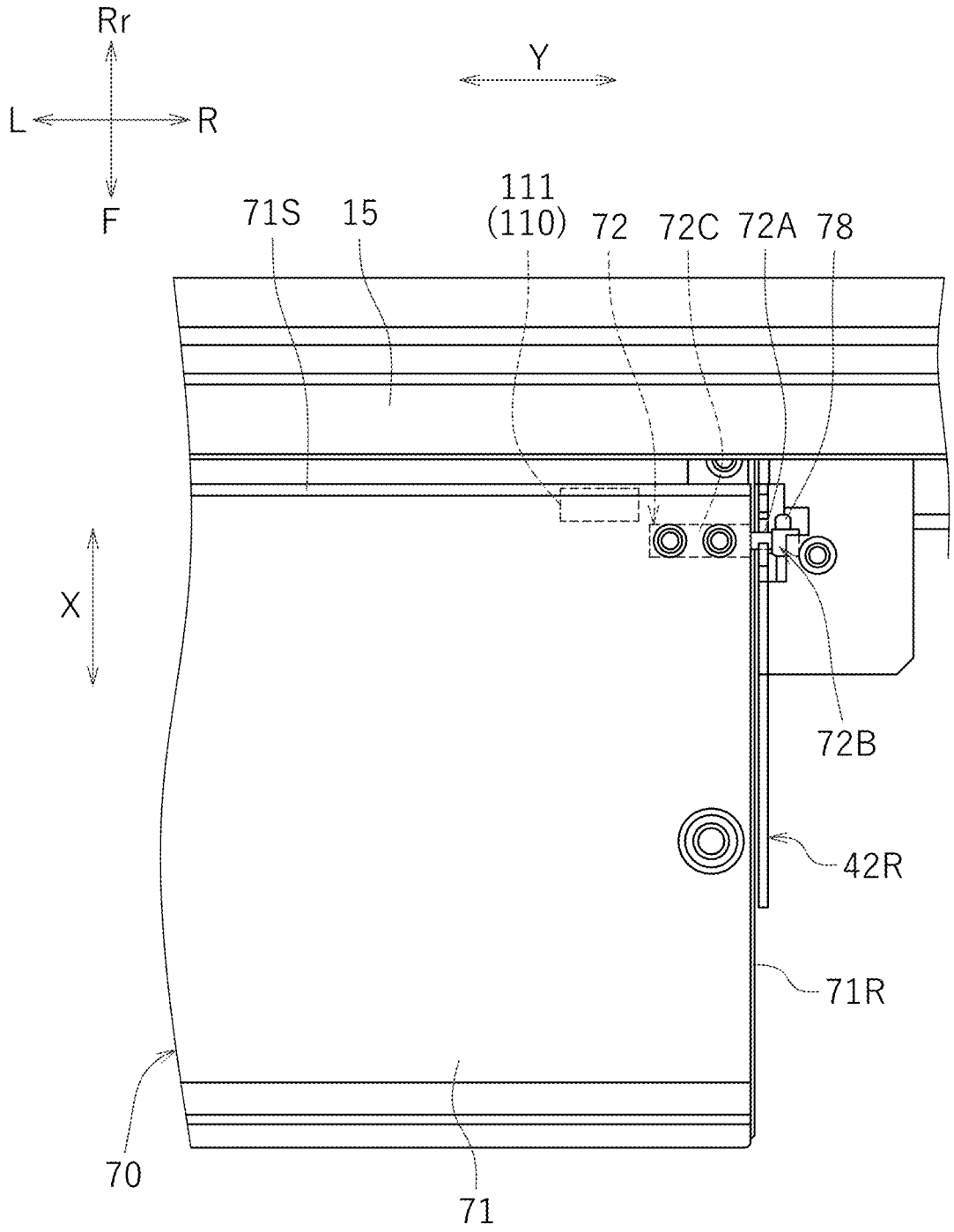
FIG. 17 is a plan view illustrating a state where a downstream light leakage suppression cover according to one preferred embodiment is in contact with a first detection sensor.
Figure 18:
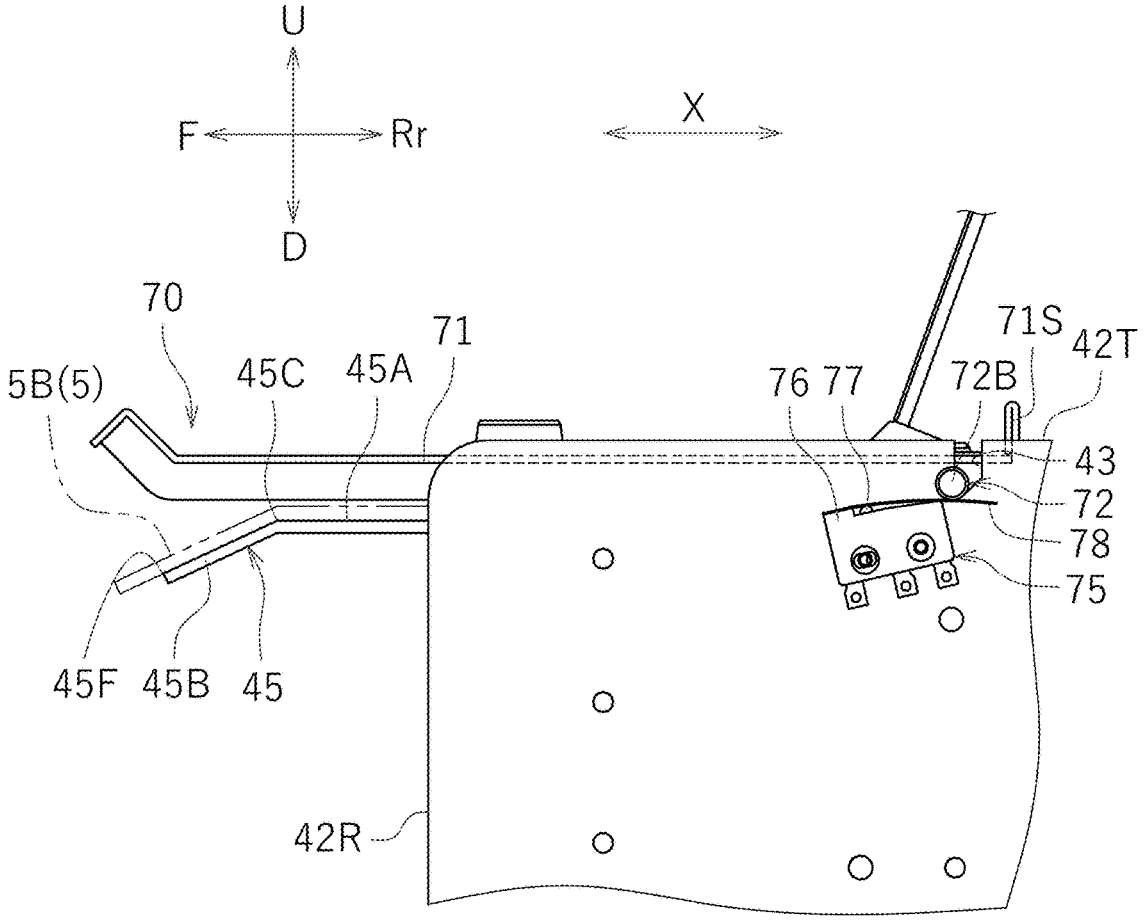
FIG. 18 is a side view illustrating a state where a downstream light leakage suppression cover according to one preferred embodiment is in contact with a first detection sensor.

As illustrated in FIGS. 3 and 6, the printer 10 includes support members 65 supporting the downstream light leakage suppression cover 70. As illustrated in FIG. 3, one of the support members 65 is provided on the second left side frame 42L. As illustrated in FIG. 6, the other support member 65 is provided on the second right side frame 42R. The support members 65 provided on the second left side frame 42L and the second right side frame 42R are symmetric in plan view with respect to a line extending in the sub-scanning direction X, and thus, the following description is directed to the support member 65 provided on the second right side frame 42R. As illustrated in FIG. 12, the support member 65 includes a fixing wall 65A attached to the second right side frame 42R, a first support wall 65B extending leftward from the front end of the fixing wall 65A and supporting the downstream light leakage suppression cover 70, and a second support wall 65C extending leftward from the upper end of the fixing wall 65A and supporting the downstream light leakage suppression cover 70. The first support wall 65B tilts downward from the rear toward the front (i.e., tilts obliquely downward). The second support wall 65C extends horizontally. As illustrated in FIG. 6, the first support wall 65B supports the downstream light leakage suppression cover 70 in a case where the recording medium 5 placed on the platen 15 is relatively thin (i.e., a case where printing is performed on the first recording medium 5A). At this time, the second support wall 65C does not support the downstream light leakage suppression cover 70. In this preferred embodiment, FIG. 7 is a plan view illustrating a state where the downstream light leakage suppression cover 70 is attached to the second right side frame 42R in a case where the first recording medium 5A is placed on the platen 15 (i.e; in the case where printing is performed on the first recording medium 5A). FIG. 9 is a side view illustrating a state where the downstream light leakage suppression cover 70 is attached to the second right side frame 42R in the case where the first recording medium 5A is placed on the platen 15. As illustrated in FIG. 16, the second support wall 65C supports the downstream light leakage suppression cover 70 in a case where the recording medium 5 of the platen 15 is relatively thick (i.e., in the case where printing is performed on the second recording medium 5B). At this time, the first support wall 65B does not support the downstream light leakage suppression cover 70. In this preferred embodiment, the second support wall 65C indirectly supports the downstream light leakage suppression cover 70 through the guide table 45, which will be described later. The second support wall 65C supports the guide table 45. More specifically, the second support wall 65C supports a placement portion 45A of the guide table 45 described later and cover support walls 47 described later are fixed an upper surface of the placement portion 45A and the downstream light leakage suppression cover 70 is supported by a second wall 47C described later of the cover support wall 47. FIG. 17 is a plan view illustrating a state where the downstream light leakage suppression cover 70 is attached to the second right side frame 42R in a case where the second recording medium 5B is placed on the platen 15 (i.e., in the case where printing is performed on the second recording medium 5B). FIG. 18 is a side view illustrating a state where the downstream light leakage suppression cover 70 is attached to the second right side frame 42R in the case where the second recording medium 5B is placed on the platen 15.

Figure 19:
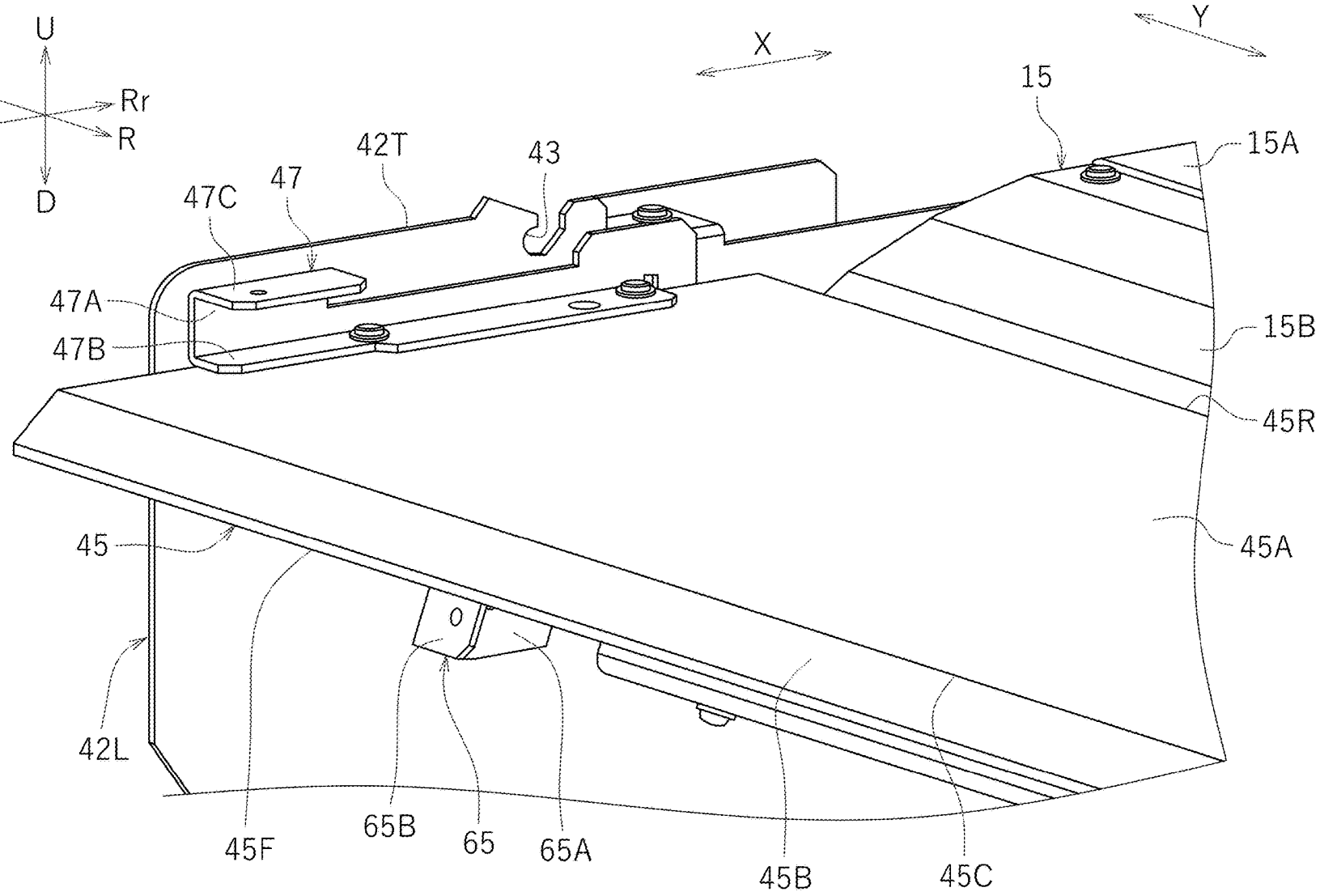
FIG. 19 is a perspective view illustrating a portion of a guide table according to one preferred embodiment.

As illustrated in FIG. 16, the printer 10 includes the guide table 45 that guides movement of the second recording medium 5B conveyed from the platen 15. That is, the guide table 45 is used in the case where the second recording medium 5B is placed on the platen 15 (i.e., in the case where printing is performed on the second recording medium 5B). The guide table 45 is detachably provided on the base member 40. The guide table 45 is attached to the second left side frame 42L and the second right side frame 42R. As illustrated in FIG. 15, the guide table 45 is disposed ahead (i.e., downstream in the sub-scanning direction X) of the first platen 15A. The guide table 45 is disposed below the first platen 15A and above a portion of the second platen 15B. The guide table 45 is disposed below the plate-shaped member 71 of the downstream light leakage suppression cover 70. The guide table 45 includes the placement portion 45A including a flat upper surface on which the second recording medium 5B is placed, a sloped portion 45B which is located ahead of the placement portion 45A and on which the second recording medium 5B is placed, and a rear end portion 45R which is located behind the placement portion 45A and on which the second recording medium 5B is not placed. The placement portion 45A is located below the first platen 15A and above a portion of the second platen 15B. The upper surface of the placement portion 45A is parallel to a horizontal plane, for example. In this preferred embodiment, the second recording medium 5B has relatively high rigidity and is not easily bent, and thus, the second recording medium 5B conveyed from the first platen 15A does not move along the second platen 15B and moves onto the upper surface of the placement portion 45A. As illustrated in FIG. 19, the placement portion 45A extends in the main scanning direction Y and the sub-scanning direction X. The length of the placement portion 45A in the main scanning direction Y is equal to the length of the platen 15 in the main scanning direction Y. As illustrated in FIG. 15, the sloped portion 45B extends forward from the front end of the placement portion 45A (i.e., downstream from the downstream end of the placement portion 45A in the sub-scanning direction X). The upper surface of the sloped portion 45B tilts obliquely downward from the rear toward the front (i.e., from the upstream side toward the downstream side in the sub-scanning direction X). The length of the sloped portion 45B in the sub-scanning direction X is smaller than the length of the placement portion 45A in the sub-scanning direction X. An angle β formed by the upper surface of the placement portion 45A and the upper surface of the sloped portion 45B is, for example, 200° to 240° (e.g., 210°). The rear end portion 45R has a substantially L shape projecting rearward. Accordingly, the end surface of the second recording medium 5B conveyed from the first platen 15A is not easily caught by the guide table 45 so that the second recording medium 5B can be thereby smoothly conveyed. The front end 45F (i.e., the front end of the sloped portion 45B) of the guide table 45 is located behind the front end 70F of the downstream light leakage suppression cover 70. The front end 45F of the guide table 45 (i.e., the front end of the sloped portion 45B) is located ahead (i.e., downstream in the sub-scanning direction X) of the front end 15BF (i.e., the downstream end in the sub-scanning direction X) of the second platen 15B. The rear end portion 45R of the guide table 45 is located behind the rear end 70R of the downstream light leakage suppression cover 70. In this preferred embodiment, in side view (when seen from the right to the left in the main scanning direction Y), a length LX of the second recording medium 5B in the sub-scanning direction X is larger than a length LY from the grit rollers 36 to the front end 45F of the guide table 45.

As illustrated in FIG. 19, the guide table 45 includes cover support walls 47 that are disposed at the left end and the right end of the placement portion 45A, allow the placement portion 45A to be supported by the second left side frame 42L, and support the downstream light leakage suppression cover 70 from below. The cover support walls 47 causing the second left side frame 42L and the second right side frame 42R to support are symmetric in plan view with respect to a line extending in the sub-scanning direction X, and thus, the following description is directed to the cover support wall 47 provided on the second left side frame 42L. The cover support wall 47 includes a fixing wall 47A disposed to face the second left side frame 42L in attaching the guide table 45, a first side wall 47B extending rightward from the lower end of the fixing wall 47A and connected to the placement portion 45A, and a second wall 47C extending rightward from the upper end of the fixing wall 47A and supporting the downstream light leakage suppression cover 70.

As illustrated in FIGS. 15 and 16, the downstream light leakage suppression cover 70 includes a suppression member 110 that suppresses rising of the second recording medium 5B moving on the guide table 45. The suppression member 110 is used in the case where the second recording medium 5B is placed on the platen 15 (i.e., in the case where printing is performed on the second recording medium 5B). The suppression member 110 is detachably provided on the plate-shaped member 71 of the downstream light leakage suppression cover 70. As illustrated in FIG. 16, the suppression member 110 is provided on a rear portion (i.e., the upstream side in the sub-scanning direction X) of the plate-shaped member 71. The suppression member 110 is provided behind the front cover 60. The suppression member 110 is provided ahead (i.e., downstream in the sub-scanning direction X) of the first platen 15A. The suppression member 110 is provided on the back surface of the plate-shaped member 71. The suppression member 110 projects from the plate-shaped member 71 toward the guide table 45. That is, the suppression member 110 projects downward from the plate-shaped member 71. The suppression member 110 has a rectangular parallelepiped shape, for example. The suppression member 110 is preferably disposed to be contactable with a non-printing region (i.e., a region onto which no ink is discharged) in the second recording medium 5B. Since the suppression member 110 contacts the second recording medium 5B, the suppression member 110 is preferably made of a material having a low friction resistance with respect to the second recording medium 5B. The suppression member 110 is made of a resin material (e.g., a polyacetal resin), for example. In a case where the plate-shaped member 71 is made of a metal material, for example, a magnet 115 is provided on a surface of the suppression member 110 facing the plate-shaped member 71, and the suppression member 110 is attached to the plate-shaped member 71 with the magnet 115 interposed therebetween. At this time, positions of the suppression member 110 in the main scanning direction Y and the sub-scanning direction X can be freely changed with respect to the plate-shaped member 71. In this preferred embodiment, the suppression member 110 includes a first suppression member 111 that suppresses rising of a right end portion of the second recording medium 5B, and a second suppression member 112 that suppresses rising of a left end portion of the second recording medium 5B. The first suppression member 111 and the second suppression member 112 are disposed to be contactable with the non-printing region of the second recording medium 5B. The suppression member 110 is an example of a suppressor, the first suppression member 111 is an example of a first suppressor, and the second suppression member 112 is an example of a second suppressor.

In this preferred embodiment, although the second recording medium 5B has relatively high rigidity and is not easily bent as described above, the degree of hanging from the front end 45F of the guide table 45 varies depending on the basis weight (thickness) of the second recording medium. 5B, and might be greatly curved on the guide table 45 to be brought into contact with the downstream light leakage suppression cover 70. In general, ink has been discharged onto a region of the second recording medium 5B to be in contact with the downstream light leakage suppression cover 70, and thus, when this region is brought into contact with the downstream light leakage suppression cover 70, print quality might degrade. In view of this, the suppression member 110 is attached to the plate-shaped member 71 of the downstream light leakage suppression cover 70 so that rising of the second recording medium 5B moving on the guide table 45 can be thereby reduced and contact of the second recording medium 5B with the downstream light leakage suppression cover 70 can be suppressed.

Figure 24:
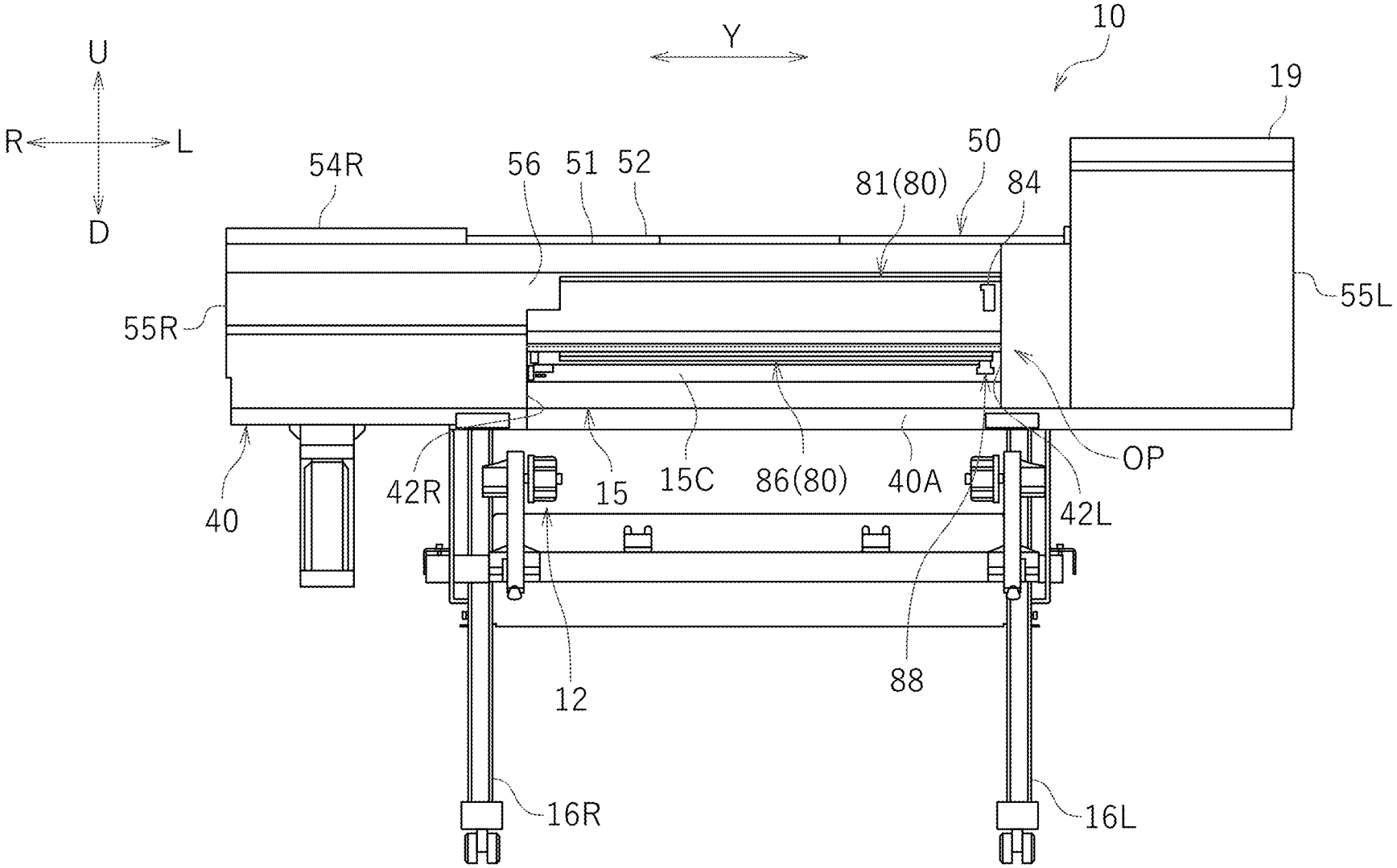
FIG. 24 is a rear view illustrating a printer according to one preferred embodiment.

As illustrated in FIG. 4, the printer 10 includes an upstream light leakage suppression cover 80 that suppresses leakage of light applied from the UV irradiators 26A and 26B (see FIG. 2) to the outside through the second opening 58B (see FIG. 3). The upstream light leakage suppression cover 80 (more specifically a plate member 82 and a plate member 87 described later) reduces light applied from the UV irradiators 26A and 26B (see FIG. 2) to, for example, 5% or less (preferably 0%). The upstream light leakage suppression cover 80 includes a first light leakage suppression cover 81 and a second light leakage suppression cover 86 (see FIG. 24). The first light leakage suppression cover 81 and the second light leakage suppression cover 86 are different in attachment mode in accordance with the thickness of the recording medium 5 placed on the platen 15, which will be described later.

As illustrated in FIG. 4, in rear view (i.e., when seen from the upstream side in the sub-scanning direction X), the first light leakage suppression cover 81 is attached to the second left side frame 42L (see FIG. 3) and the second right side frame 42R (see FIG. 6) to be pivotable between a closed position CP overlapping with the second opening 58B (see also FIG. 3) and an open position OP (see FIG. 15) not overlapping with the second opening 58B. As illustrated in FIG. 3, the first light leakage suppression cover 81 is located behind the platen 15. The first light leakage suppression cover 81 is attached to the second left side frame 42L and the second right side frame 42R in both of the case where the first recording medium 5A is placed on the platen 15 (i.e., printing is performed on the first recording medium 5A) and the case where the second recording medium 5B is placed on the platen 15 (i.e., printing is performed on the second recording medium 5B). The first light leakage suppression cover 81 is located at the closed position CP in the case where printing is performed on the first recording medium 5A, and at the open position OP in the case where printing is performed on the second recording medium 5B. Since the magnet (not shown) is provided on the rear wall 56 of the body case 50, when the first light leakage suppression cover 81 is pivoted upward, the first light leakage suppression cover 81 is kept at the open position OP, whereas when the first light leakage suppression cover 81 is pivoted downward against a magnetic force of the magnet, the first light leakage suppression cover 81 returns to the closed position CP.

Figure 20:
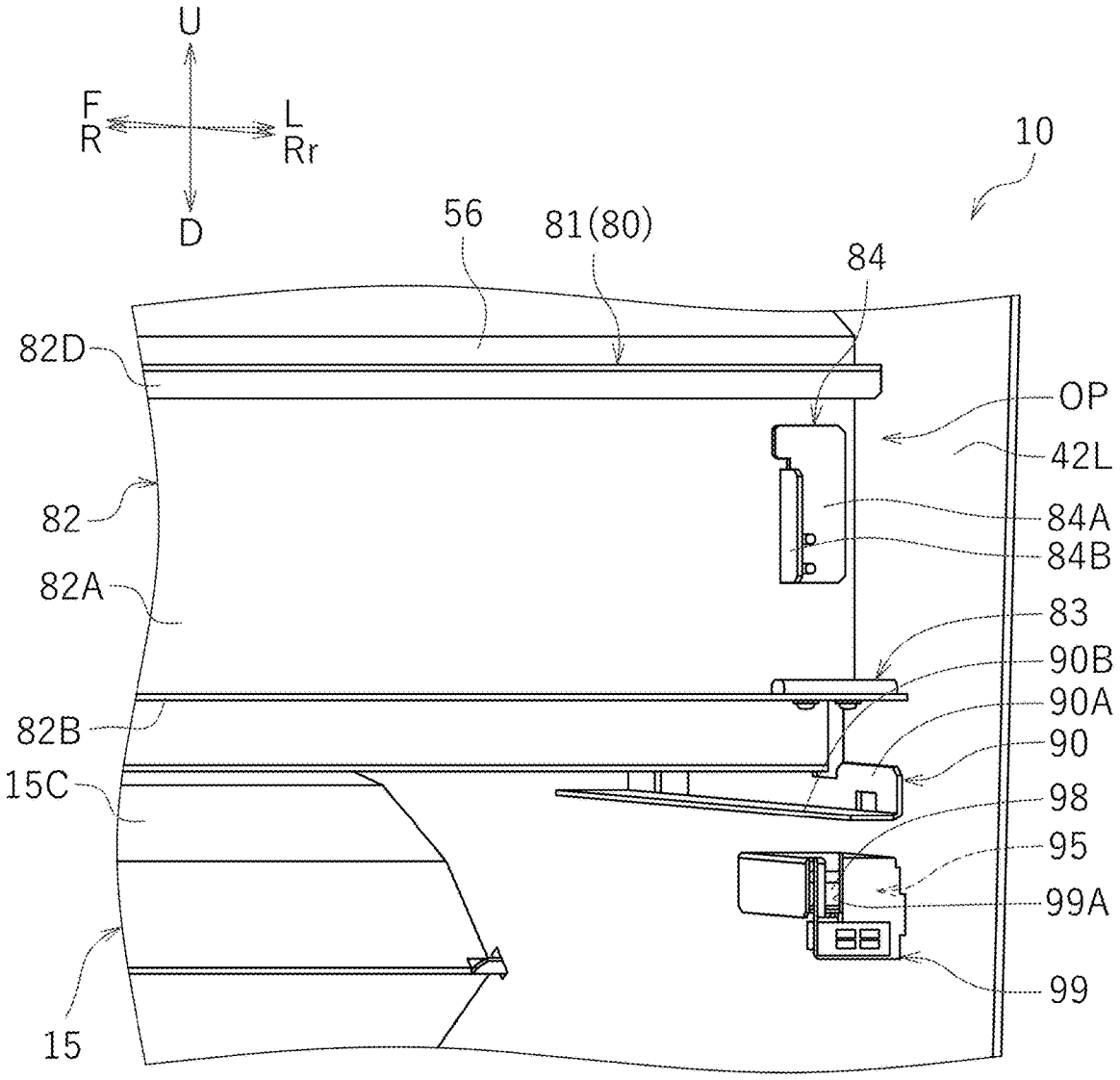
FIG. 20 is a perspective view illustrating a peripheral configuration of a second detection sensor according to one preferred embodiment.
Figure 23:
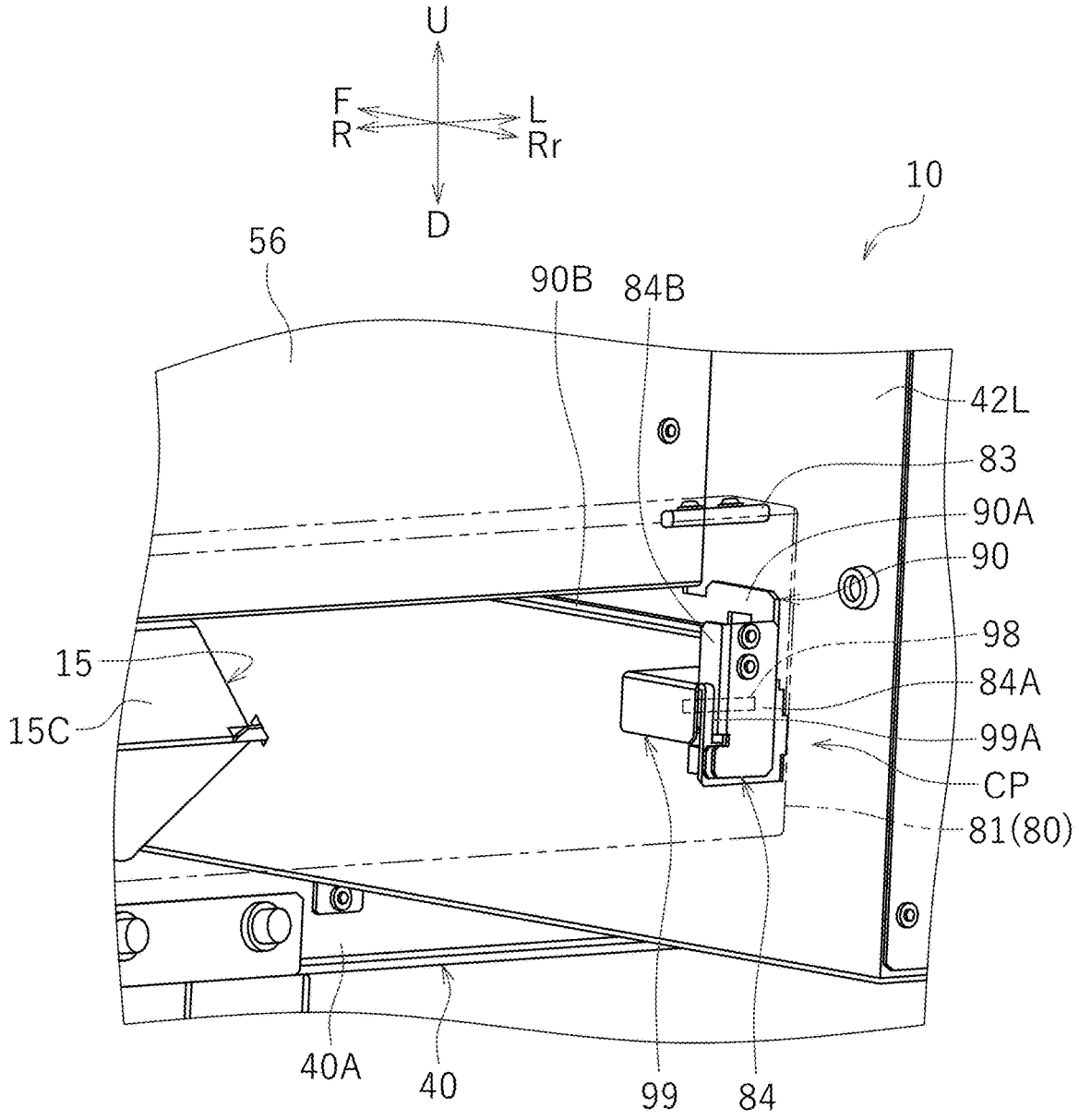
FIG. 23 is a perspective view illustrating a state where a pressing member of a first light leakage suppression cover according to one preferred embodiment is in contact with a second detection sensor.

As illustrated in FIG. 3, the first light leakage suppression cover 81 includes the plate member 82 extending in the main scanning direction Y, shafts 83 provided at the left end and the right end of the plate member 82 and pivotably attached to the second left side frame 42L and the second right side frame 42R, and a pressing sheet 84 to be in contact with the second detection sensor 95. The plate member 82 suppresses leakage of light applied from the UV irradiators 26A and 26B to the outside (to the rear) from the body case 50, and is formed by bending a sheet metal. The plate member 82 includes a first portion 82A extending in the main scanning direction Y and the top-bottom direction, a second portion 82B extending forward from the upper end of the first portion 82A, a third portion 82C extending forward from the lower end of the first portion 82A, and a fourth portion 82D extending upward from the front of the third portion 82C, while the first light leakage suppression cover 81 is located at the closed position CP. As illustrated in FIG. 20, the shaft 83 extends in the main scanning direction Y. The shaft 83 is provided on the second portion 82B of the plate member 82. The pressing sheet 84 includes a fixing wall 84A fixed to the first portion 82A of the plate member 82, and a pressing wall 84B projecting in a direction away from the fixing wall 84A (projecting rearward in the example illustrated in FIG. 20) and capable of pressing the pressing plate 98 of the second detection sensor 95. As illustrated in FIG. 23, the pressing wall 84B is configured to press the pressing plate 98 of the second detection sensor 95 shown in FIG. 21 and press a switch 97 of the second detection sensor 95 while the first light leakage suppression cover 81 is located at the closed position CP.

As illustrated in FIG. 15, the second light leakage suppression cover 86 is detachably provided on the second left side frame 42L and the second right side frame 42R (see FIG. 16) to overlap with at least a part of the second opening 58B in rear view. As illustrated in FIG. 15, the second light leakage suppression cover 86 is located behind the first platen 15A. The rear end 86R of the second light leakage suppression cover 86 is located behind the platen 15. The rear end 86R of the second light leakage suppression cover 86 is located behind the body case 50 (the rear wall 56 in this preferred embodiment). The second light leakage suppression cover 86 is detached from the second left side frame 42L and the second right side frame 42R in the case where the first recording medium 5A is placed on the platen 15 (i.e., the case where printing is performed on the first recording medium 5A), and is attached to the second left side frame 42L and the second right side frame 42R in the case where the second recording medium 5B is placed on the platen 15 (i.e., the case where printing is performed on the second recording medium 5B).

Figure 25:
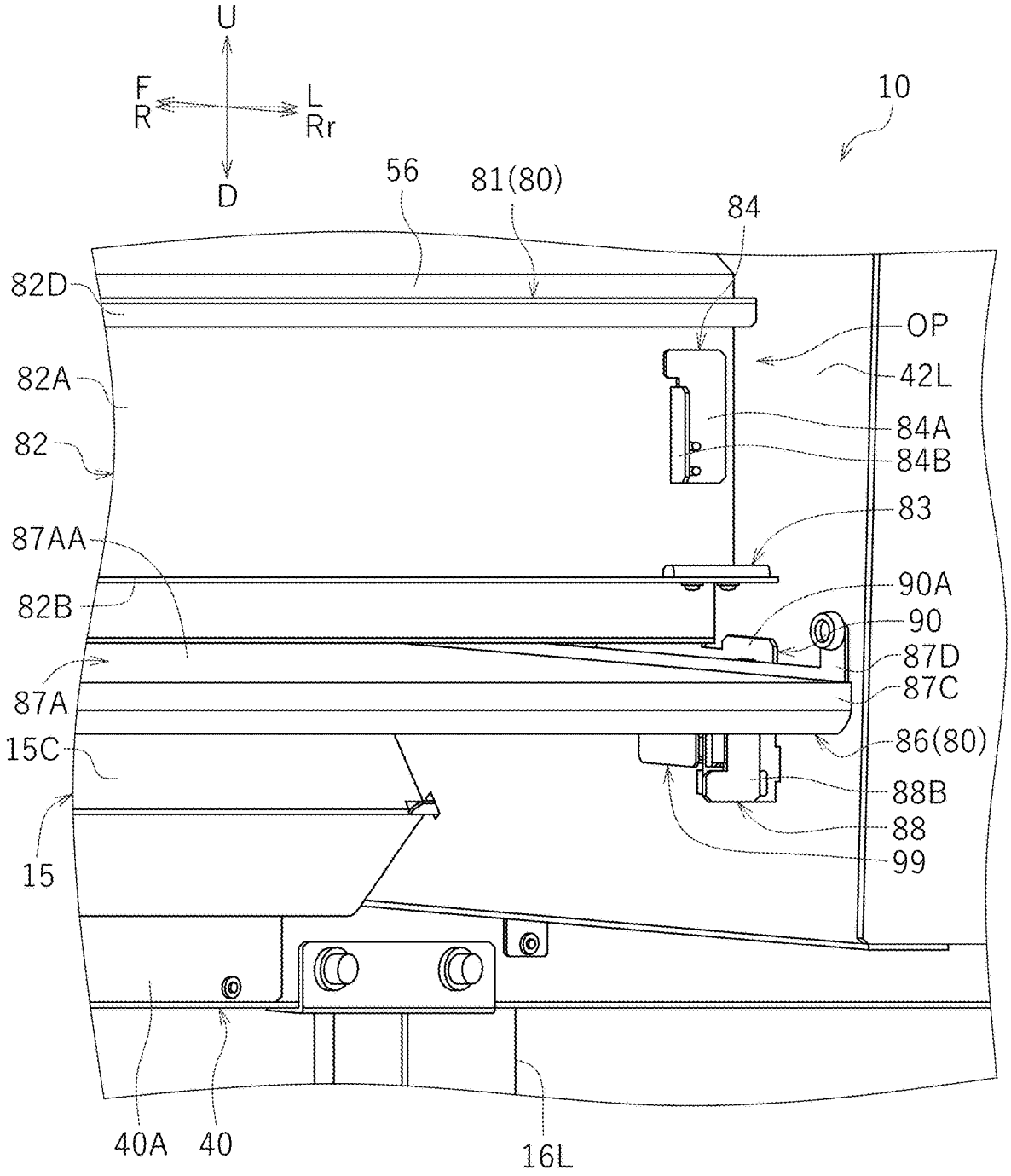
FIG. 25 is a perspective view illustrating a state where a second light leakage suppression cover according to one preferred embodiment is attached.
Figure 26:
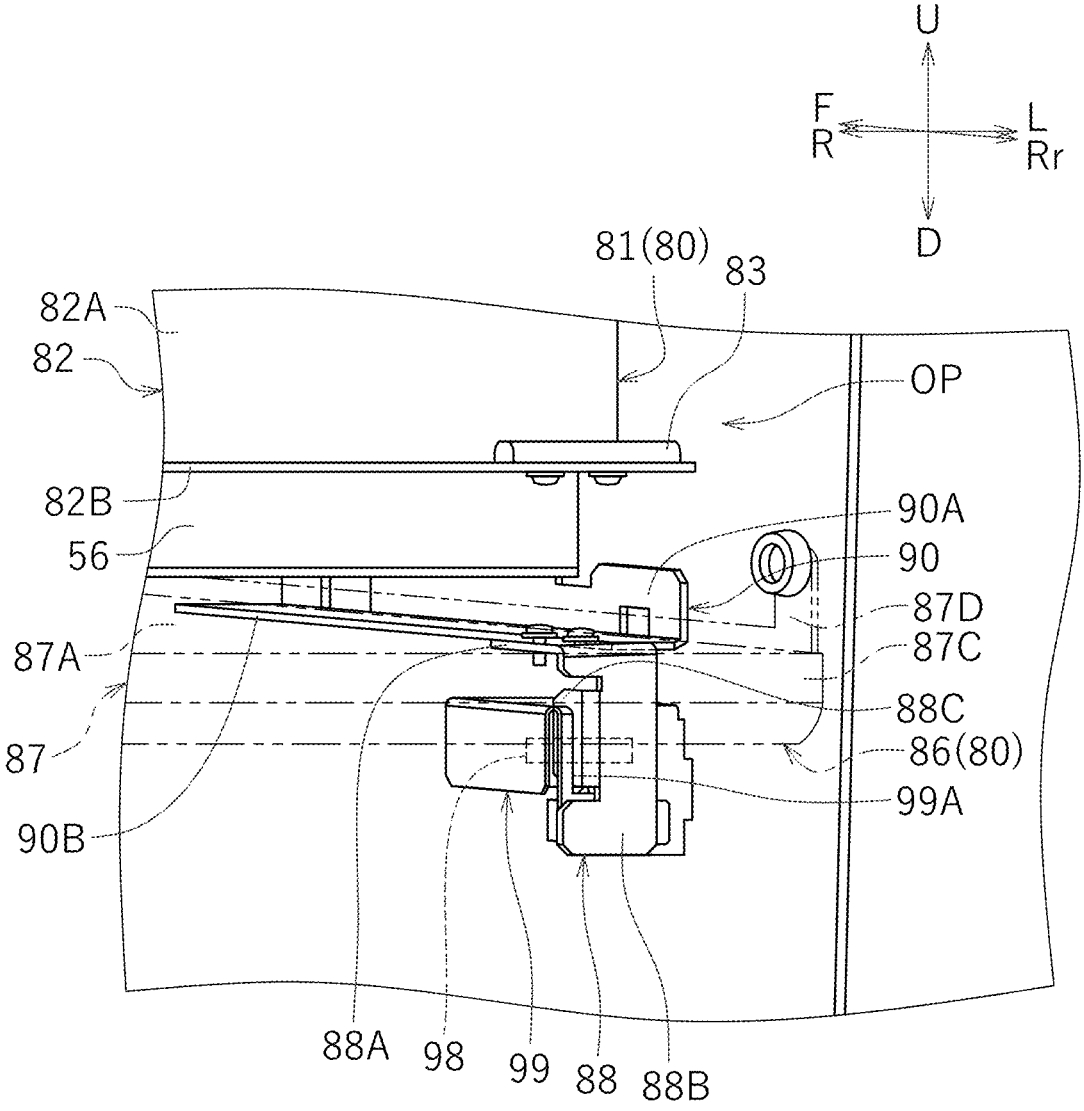
FIG. 26 is a perspective view illustrating a state where a pressing member of a second light leakage suppression cover according to one preferred embodiment is in contact with a second detection sensor.

As illustrated in FIG. 15, the second light leakage suppression cover 86 includes the plate member 87 extending in the main scanning direction Y and a pressing sheet 88 to be in contact with the second detection sensor 95. The plate member 87 includes a first portion 87A extending in the main scanning direction Y and the sub-scanning direction X, a second portion 87B extending forward and obliquely downward from the front end of the first portion 87A, a third portion 87C extending downward from the rear end of the first portion 87A, and a fourth portion 87D extending upward from the left end and the right end of the first portion 87A and fixed to the second left side frame 42L and the second right side frame 42R, while the second light leakage suppression cover 86 is attached to the second left side frame 42L and the second right side frame 42R. The first portion 87A includes a placement surface 87AA (see FIG. 25) on which the second recording medium 5B is placed. The placement surface 87AA extends in the main scanning direction Y and the sub-scanning direction X. As illustrated in FIG. 26, the pressing sheet 88 includes a fixing wall 88A fixed to first portion 87A of the plate member 87, a vertical wall 88B projecting in a direction away from the fixing wall 88A (below in the example illustrated in FIG. 26), and a pressing wall 88C projecting in a direction away from the vertical wall 88B (forward in the example illustrated in FIG. 26) and capable of pressing the pressing plate 98 of the second detection sensor 95 (see FIG. 20). The pressing wall 88C is configured to press the pressing plate 98 of the second detection sensor 95 and press the switch 97 of the second detection sensor 95 while the second light leakage suppression cover 86 is attached to the second left side frame 42L and the second right side frame 42R.

Figure 21:
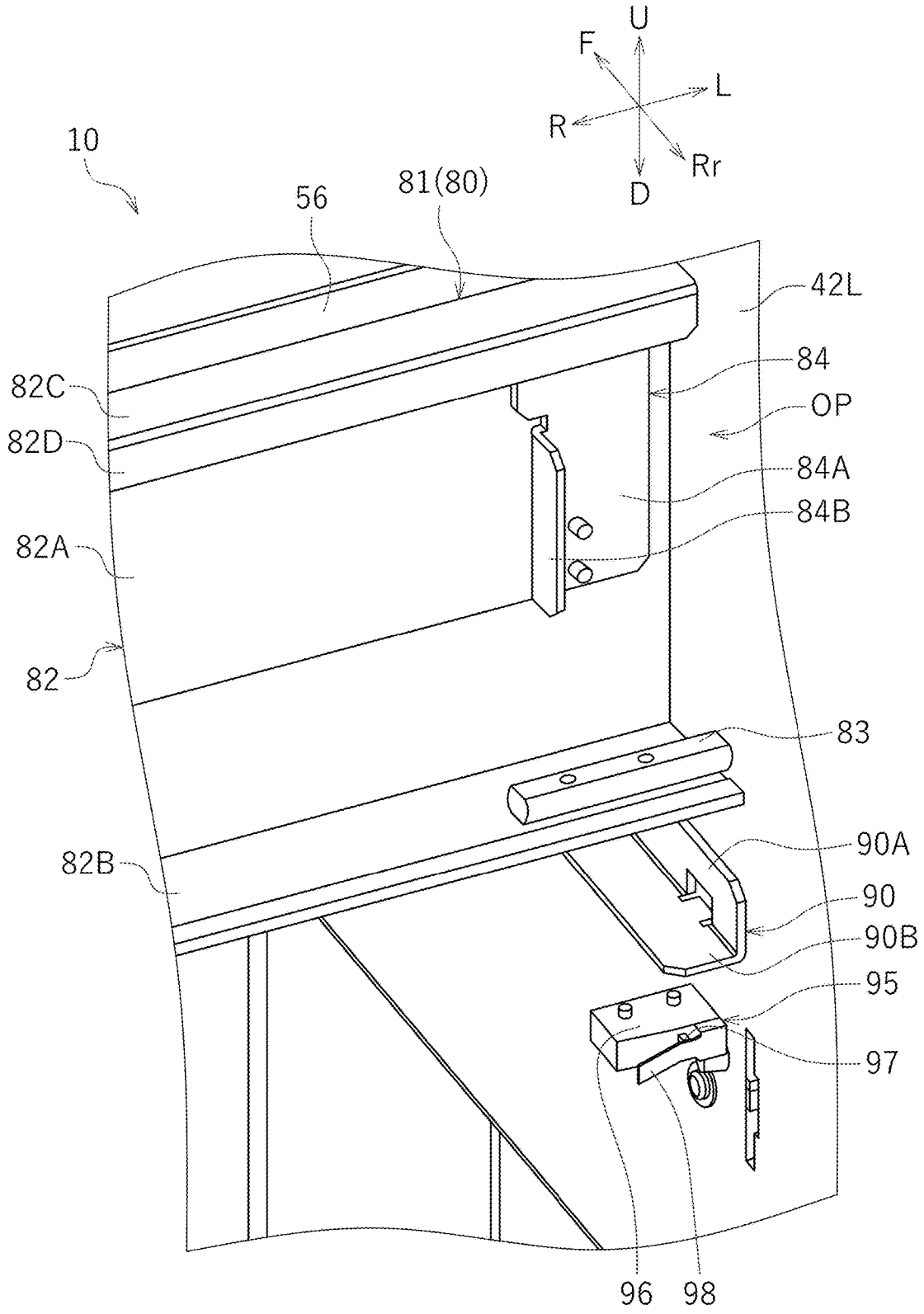
FIG. 21 is a perspective view illustrating a second detection sensor according to one preferred embodiment.

As illustrated in FIG. 21, the printer 10 includes the second detection sensor 95 that detects whether the upstream light leakage suppression cover 80 is attached or not. In this preferred embodiment, the second detection sensor 95 has the same configuration as that of the first detection sensor 75. The second detection sensor 95 detects that the upstream light leakage suppression cover 80 is attached when the pressing wall 84B of the pressing sheet 84 of the first light leakage suppression cover 81 is in contact with the second detection sensor 95 and when the pressing wall 88C (see FIG. 26) of the pressing sheet 88 of the second light leakage suppression cover 86 is in contact with the second detection sensor 95. The second detection sensor 95 is provided on the second left side frame 42L. The second detection sensor 95 is provided on a surface of the second left side frame 42L in the main scanning direction Y facing the platen 15. In this preferred embodiment, the second detection sensor 95 is provided on the right surface of the second left side frame 42L. The second detection sensor 95 includes a box-shaped body 96, a switch 97 which is provided on the body 96 and turns on when being pressed and detects that the upstream light leakage suppression cover 80 is attached, and a pressing plate 98 that is provided on the body 96 to move forward and rearward (i.e., in the sub-scanning direction X) and presses the switch 97 when being pressed from the rear by the pressing wall 84B of the pressing sheet 84 of the first light leakage suppression cover 81 or the pressing wall 88C of the pressing sheet 88 of the second light leakage suppression cover 86. The pressing plate 98 is a thin plate member that is elastically deformable. FIG. 21 does not show a cover member 99 described later.

Figure 22:
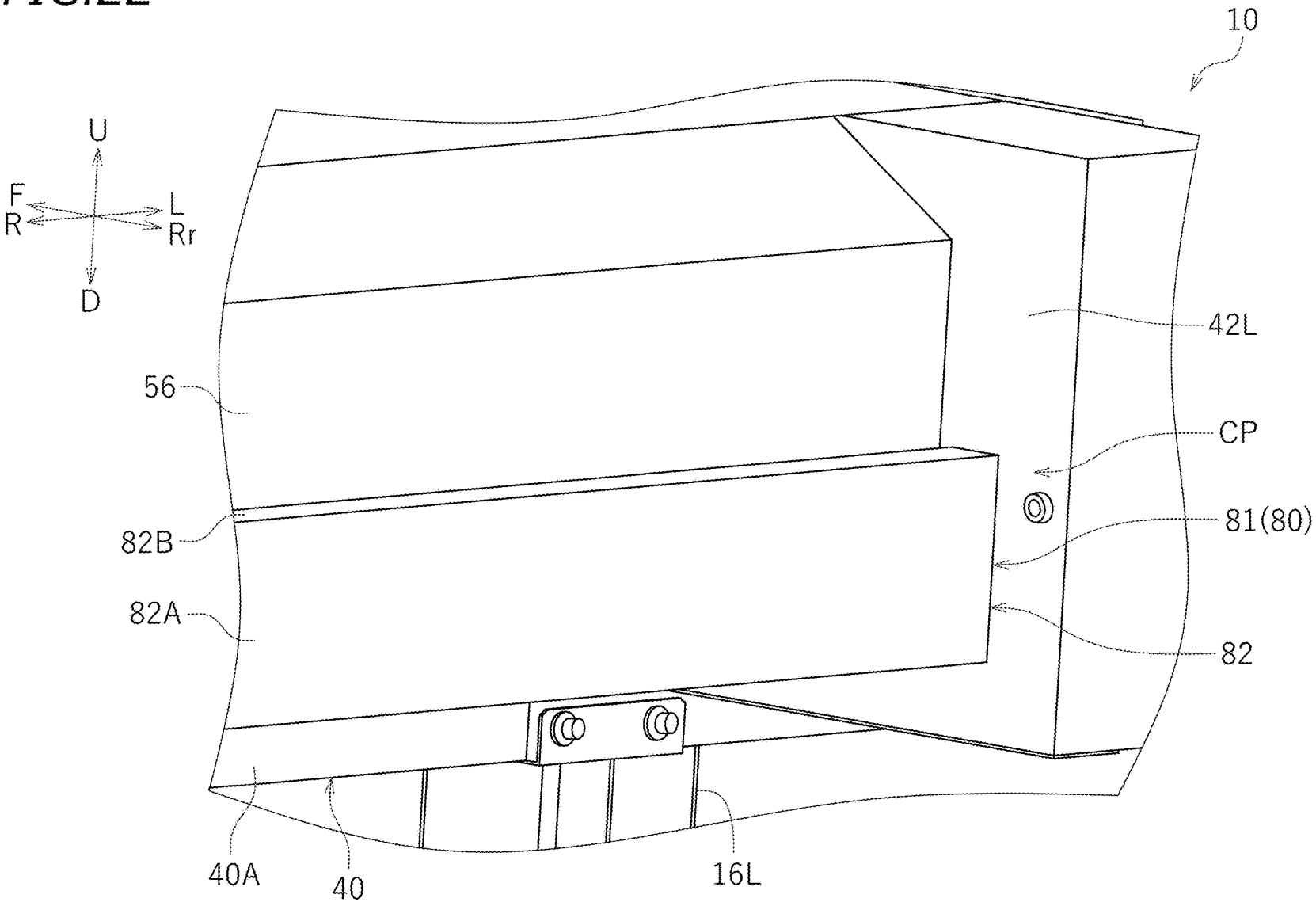
FIG. 22 is a perspective view illustrating a state where a first light leakage suppression cover according to one preferred embodiment is located at a closed position.

The second detection sensor 95 is configured to detect that the upstream light leakage suppression cover 80 is attached when the first light leakage suppression cover 81 is located at the closed position CP (see FIG. 22) in the case where the first recording medium 5A is placed on the platen 15 (i.e., the case where printing is performed on the first recording medium 5A). The second detection sensor 95 is configured to detect that the upstream light leakage suppression cover 80 is attached when the first light leakage suppression cover 81 is located at the open position OP and the second light leakage suppression cover 86 is attached to the second left side frame 42L and the second right side frame 42R in the case where the second recording medium 5B is placed on the platen 15 (i.e., the case where printing is performed on the second recording medium 5B).

As illustrated in FIG. 20, the cover member 99 is disposed around the second detection sensor 95 to cover the second detection sensor 95. The cover member 99 is attached to the second left side frame 42L. The cover member 99 is brought into contact with the fixing wall 84A of the pressing sheet 84 of the first light leakage suppression cover 81 and the vertical wall 88B of the pressing sheet 88 of the second light leakage suppression cover 86 (see FIG. 26) and suppresses excessive pressing of the pressing plate 98 of the second detection sensor 95 by the pressing wall 84B of the pressing sheet 84 and the pressing wall 88C of the pressing sheet 88. The cover member 99 has an opening 99A. The opening 99A overlaps with the pressing plate 98 of the second detection sensor 95 in rear view.

As illustrated in FIG. 3, the printer 10 includes support plates 90 supporting the second light leakage suppression cover 86. The support plates 90 are individually attached to the second left side frame 42L and the second right side frame 42R (see FIG. 6). The support plates 90 attached to the second left side frame 42L and the second right side frame 42R are symmetric in plan view with respect to a line extending in the sub-scanning direction X, and thus, the following description is directed to the support plate 90 provided on the second left side frame 42L. As illustrated in FIGS. 20 and 21, the support plate 90 extends in the sub-scanning direction X. The support plate 90 includes a fixing wall 90A fixed to the second left side frame 42L, and a support wall 90B extending in a direction away from the fixing wall 90A (rightward in this preferred embodiment) and supporting the second light leakage suppression cover 86 from below. The support plates 90 is disposed above the second detection sensor 95.

The controller 100 controls printing of an image on the recording media 5. The controller 100 is not limited to a specific configuration. The controller 100 is, for example, a microcomputer. A hardware architecture of the microcomputer is not specifically limited. The microcomputer may include, for example, an interface (I/F) that receives printing data and other data from external equipment such as a host computer, a central processing unit (CPU) that executes an instruction of a control program, a read only memory (ROM) that stores programs to be executed by the CPU, a random access memory (RAM) that is used as a working area where programs are developed, and a memory that stores the programs, the data, and so forth. As illustrated in FIG. 1, the controller 100 is provided in the body case 50.

The controller 100 controls driving of a feed motor (not shown) to thereby control rotation of the grit rollers 36. In this manner, movement the recording medium 5 placed on the platen 15 is controlled in the sub-scanning directions X. The controller 100 controls driving of the carriage motor 34 to thereby move the carriage 22 in the main scanning direction Y. That is, the controller 100 moves the ink heads 24 and the UV irradiators 26A and 26B in the main scanning direction Y. The controller 100 controls timings when ink is discharged from the first nozzles 24A and the second nozzles 24B of the ink heads 24 and the amount of discharge of the ink, for example. The controller 100 controls timing when light is applied from the UV irradiators 26A and 26B onto photocurable ink discharged on the recording medium 5 and the amount of the light, for example.

The controller 100 is configured to discharge photocurable ink from the ink heads 24 onto the recording medium 5 and causes the UV irradiators 26A and 26B to apply light when the first detection sensor 75 detects attachment of the downstream light leakage suppression cover 70 and the second detection sensor 95 detects attachment of the upstream light leakage suppression cover 80. That is, the printer 10 according to this preferred embodiment is configured such that printing is allowed to be performed on the recording media 5 only while both the downstream light leakage suppression cover 70 and the upstream light leakage suppression cover 80 are securely attached to the second left side frame 42L and the second right side frame 42R. The controller 100 is configured to stop discharge of photocurable ink from the ink heads 24 onto the recording medium 5 and application of light from the UV irradiators 26A and 26B when at least one of the downstream light leakage suppression cover 70 and the upstream light leakage suppression cover 80 is detached from the second left side frame 42L and the second right side frame 42R.

As described above, in the printer 10 according to this preferred embodiment, in the case of using the sheet-like second recording medium 5B, the guide table 45 is attached to the base member 40 so that movement of the second recording medium 5B conveyed from the first platen 15A is thereby guided by the guide table 45. In this case, the guide table 45 includes the placement portion 45A located below the first platen 15A and above a portion of the second platen 15B. Since the placement portion 45A has a flat upper surface, the relatively thick second recording medium 5B can be conveyed without being bent significantly. In the case of using the rolled first recording medium 5A, the guide table 45 is detached from the base member 40 so that movement of the first recording medium 5A conveyed from the first platen 15A is thereby guided by the second platen 15B. In this case, although the upper surface of the second platen 15B tilts obliquely downward from the rear toward the front, since the relatively thin first recording medium 5A is easily bent, the first recording medium 5A can be conveyed along the upper surface of the second platen 15B. As described above, by attaching the guide table 45 to the base member 40, the second recording medium 5B can be conveyed by using the configuration for conveying the first recording medium 5A. That is, the first recording medium 5A and the second recording medium 5B can be selectively used by attaching and detaching the guide table 45 to/from the base member 40.

In the printer 10 according to this preferred embodiment, the guide table 45 further includes the sloped portion 45B extending forward from the front end of the placement portion 45A and including the upper surface tilted obliquely downward from the rear toward the front. Accordingly, the second recording medium 5B moves along the sloped portion 45B. At this time, a front end portion of the second recording medium 5B contacts two points of a front end portion of the sloped portion 45B (the front end 45F of the guide table 45 in this preferred embodiment) and a connection portion 45C (see FIG. 18) where the placement portion 45A and the sloped portion 45B are connected, and thus, a tension is applied at the two points to the second recording medium 5B between the front end portion of the sloped portion 45B and the connection portion 45C. Thus, a portion that is not placed on the guide table 45 (a downstream portion of the second recording medium 5B) hangs down from the portion to which the tension is applied, and thus, rising of the second recording medium 5B from the contact portion between the second recording medium 5B and the guide table 45 can be suppressed. On the other hand, in a case where the front end portion of the second recording medium. 5B contacts the guide table 45 at one point (i.e., a case where the guide table 45 does not have the sloped portion 45B), the second recording medium 5B hangs down from the contact portion between the second recording medium 5B and the guide table 45, and thus, the second recording medium 5B rises from the contact portion. Accordingly, in conveying the second recording medium 5B, the sloped portion 45B of the guide table 45 can suppress rising of the second recording medium 5B from the contact portion between the second recording medium 5B and the guide table 45, and thus, contact between the second recording medium 5B and the carriage 22 can be suppressed.

In the printer 10 according to this preferred embodiment, the length LX of the second recording medium 5B in the sub-scanning direction X is larger than the length LY from the grit rollers 36 to the front end 45F of the guide table 45 in side view. In this preferred embodiment, if the length LX of the second recording medium 5B in the sub-scanning direction X is smaller than the length LY from the grit rollers 36 to the front end 45F of the guide table 45, the second recording medium 5B does not include a portion that is not placed on the guide table 45 in the case where the second recording medium 5B is placed on the guide table 45 at the start of printing, and thus, no portion of the second recording medium 5B hangs down from the guide table 45. On the other hand, if the length LX of the second recording medium 5B in the sub-scanning direction X is larger than the length LY from the grit rollers 36 to the front end 45F of the guide table 45, the second recording medium 5B includes a portion that is not placed on the guide table 45 in the case where the second recording medium 5B is placed on the guide table 45 at the start of printing, and thus, the second recording medium. 5B has a portion hanging down from the guide table 45. Even in this case, since rising of the entire second recording medium 5B is suppressed by the front end portion of the sloped portion 45B (the front end 45F of the guide table 45 in this preferred embodiment) and the connection portion 45C (see FIG. 18) between the placement portion 45A and the sloped portion 45B, it is possible to suppress contact between the second recording medium 5B and the carriage 22 caused by rising of the second recording medium 5B near the grit rollers 36.

In the printer 10 according to this preferred embodiment, the front end 45F of the guide table 45 is located ahead of the second platen 15B. Accordingly, the second recording medium 5B having the relatively large length LX in the sub-scanning direction X can also be conveyed without being significantly bent.

The printer 10 according to this preferred embodiment includes the plate-shaped member 71 that suppresses leakage of light applied from the UV irradiators 26A and 26B to the outside through a gap between the front cover 60 and the platen 15, and includes the downstream light leakage suppression cover 70 to be attached to the base member 40 or the body case 50, and the guide table 45 is disposed below the plate-shaped member 71. Accordingly, it is possible to suppress leakage of light applied from the UV irradiators 26A and 26B to the outside through a gap between the front cover 60 and the platen 15, and the relatively thick second recording medium 5B can be conveyed without being significantly bent.

In the printer 10 according to this preferred embodiment, the support member 65 provided on the base member 40 includes the first support wall 65B supporting the downstream light leakage suppression cover 70 and tilted downward from the rear toward the front in the case where the first recording medium 5A is conveyed, and the second support wall 65C supporting the downstream light leakage suppression cover 70 and extending horizontally in the case where the second recording medium 5B is conveyed. As described above, the use of the support member 65 enables the angle of the downstream light leakage suppression cover 70 with respect to the front cover 60 to be changed easily.

In the printer 10 according to this preferred embodiment, the second support wall 65C is configured to support the placement portion 45A of the guide table 45, and the guide table 45 includes the cover support walls 47 supporting the downstream light leakage suppression cover 70 from below. As described above, by changing a portion of the support member 65 supporting the guide table 45, the angle of the downstream light leakage suppression cover 70 with respect to the front cover 60 can be changed to a predetermined angle in correspondence with detachment and attachment of the guide table 45. Thus, in either case of printing on the first recording medium 5A and the second recording medium 5B, it is possible to suppress leakage of light applied from the UV irradiators 26A and 26B to the outside through a gap between the front cover 60 and the platen 15 by changing the attachment angle of the single type of the downstream light leakage suppression cover 70.

In the printer 10 according to this preferred embodiment, the front end 70F of the downstream light leakage suppression cover 70 is located ahead of the front end 45F of the guide table 45. Accordingly, it is possible to suppress leakage of light applied from the UV irradiators 26A and 26B upward through a gap between the downstream light leakage suppression cover 70 and the guide table 45.

In the printer 10 according to this preferred embodiment, the downstream light leakage suppression cover 70 includes the suppression member 110 disposed upstream of the plate-shaped member in the sub-scanning direction X, projecting from the plate-shaped member 71 toward the guide table 45, and configured to suppress rising of the second recording medium 5B moving on the guide table 45. Accordingly, contact between the second recording medium 5B and the downstream light leakage suppression cover 70 can be suppressed so that degradation of quality of an image printed on the second recording medium 5B can be thereby suppressed. In a case where the guide table 45 has a sufficiently large length in the sub-scanning direction X, even when the second recording medium 5B hangs down from a downstream end portion of the guide table 45 in the sub-scanning direction X (the front end 45F in this preferred embodiment), the second recording medium 5B hardly rises, but since the area of the guide table 45 is large in this case, an installation place of the printer is restricted. In a case where the guide table 45 has a relatively small length in the sub-scanning direction X, the area of the guide table 45 is small, but the second recording medium 5B hangs down from a downstream end portion (the front end 45F in this preferred embodiment) of the guide table 45 in the sub-scanning direction X and thereby easily rises. On the other hand, the suppression member 110 provided on the downstream light leakage suppression cover 70 as described in the printer 10 according to this preferred embodiment can suppress rising of the second recording medium 5B, independently of the length of the guide table 45.

In the printer 10 according to this preferred embodiment, the suppression member 110 is detachably provided on the plate-shaped member 71. Accordingly, positions of the suppression member 110 in the main scanning direction Y and the sub-scanning direction X with respect to the plate-shaped member 71 can be changed so that the suppression member 110 can be disposed at an appropriate position in accordance with the size of the second recording medium 5B. In addition, the position of the suppression member 110 can be changed such that a non-printing region (i.e., a margin) of the second recording medium 5B and the suppression member 110 are brought into contact with each other.

In the printer 10 according to this preferred embodiment, the suppression member 110 includes the first suppression member 111 that suppresses rising of one end portion (a right end portion in this preferred embodiment) of the second recording medium 5B in the main scanning direction Y and the second suppression member 112 that suppresses rising of the other end portion (a left end portion in this preferred embodiment) of the second recording medium 5B in the main scanning direction Y. In a case where an ambient temperature around the first platen 15A and the guide table 45 is relatively high, warpage occurs in both end portions of the second recording medium. 5B in the main scanning direction Y (i.e., the left end portion and the right end portion), and at least one of the both end portions of the second recording medium 5B might contact the carriage 22. However, the first suppression member 111 and the second suppression member 112 can suppress rising of the both end portions of the second recording medium. 5B so that contact of the second recording medium 5B and the carriage 22 can be thereby suppressed.

The foregoing description is directed to the preferred embodiment of the present teaching. The preferred embodiment described above, however, is merely an example, and the present teaching can be performed in various modes.

In the preferred embodiment described above, the front cover 60 is pivotably provided on the first left side frame 41L and the first right side frame 41R, but may be pivotably provided on the body case 50. The downstream light leakage suppression cover and the upstream light leakage suppression cover 80 are detachably provided on the second left side frame 42L and the second right side frame 42R, but may be detachably provided on the body case 50.

In the preferred embodiment described above, the first detection sensor 75 is provided on the second right side frame 42R, but may be provided on the second left side frame 42L. The second detection sensor 95 is provided on the second left side frame 42L, but may be provided on the second right side frame 42R.

In the preferred embodiment described above, the first portion 72A is indirectly connected to the plate-shaped member 71 with the third portion 72C interposed therebetween, but the first portion 72A may be directly connected to the plate-shaped member 71.

In the preferred embodiment described above, the downstream light leakage suppression cover 70 is configured to be attached to the front cover 60 at two different angles, but may be attached at three or more different angles. In the case where the recording medium 5 is relatively thick, the downstream light leakage suppression cover 70 is provided to tilt downward toward the downstream side in the sub-scanning direction X, but may not tilt. Specifically, in a case where the front cover 60 does not tilt and extends in the top-bottom direction (i.e., extends in a direction orthogonal to the first platen 15A), the downstream light leakage suppression cover 70 may extend in the top-bottom direction in correspondence with the extension direction of the front cover 60. In a case where the recording medium 5 is relatively thick, the downstream light leakage suppression cover 70 is disposed to extend horizontally toward the downstream side in the sub-scanning direction X, but in a case where the length of the front cover 60 in the top-bottom direction is changed, for example, the position of the upstream end of the downstream light leakage suppression cover 70 in the sub-scanning direction X is changed. In this case, the downstream light leakage suppression cover 70 may be tilted downward or upward in accordance with the position of the upstream end of the downstream light leakage suppression cover 70 in the sub-scanning direction X.

In the preferred embodiment described above, the first nozzles 24A and the second nozzles 24B of the ink heads 24 are configured to discharge photocurable ink onto the recording media 5, and the ink head unit 20 includes the UV irradiators 26A and 26B. However, the present teaching is not limited to this example. In the printer 10 including the guide table 45 detachably attached to the base member 40, in the case of selectively using the first recording medium 5A and the second recording medium 5B having different thicknesses, ink to be used may be solvent ink or aqueous ink. In using these inks, the UV irradiators 26A and 26B are unnecessary.

In the preferred embodiment described above, the guide table 45 is used in the case where the recording medium 5 is relatively thick (i.e., the case where printing is performed on the second recording medium 5B). However, the guide table 45 is used in the case of printing not on the rolled first recording medium 5A but on the sheet-like second recording medium 5B, and in this case, the second recording medium 5B may be relatively thin.

Figure 27:
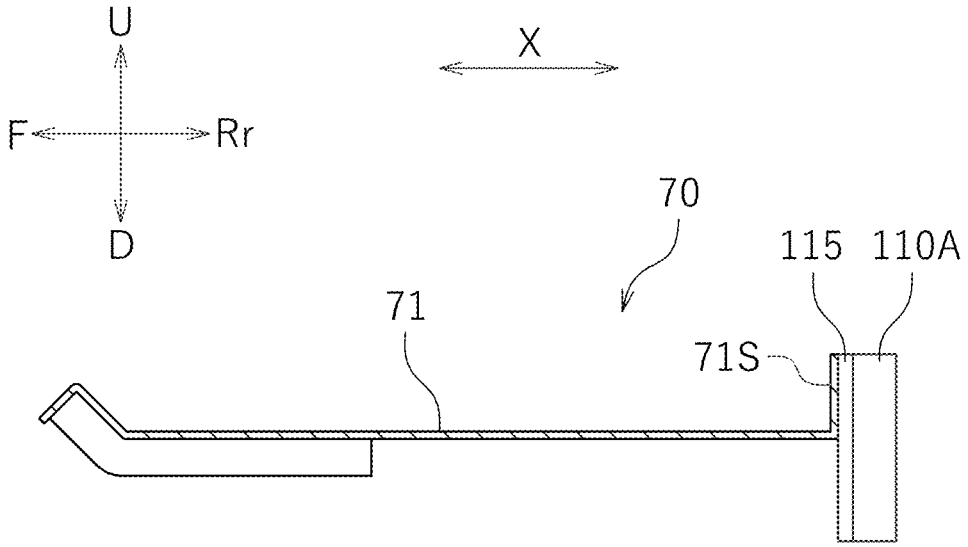
FIG. 27 is a cross-sectional view illustrating a state where a suppression member according to a variation is provided on a plate-shaped member of a downstream light leakage suppression cover.
Figure 28:
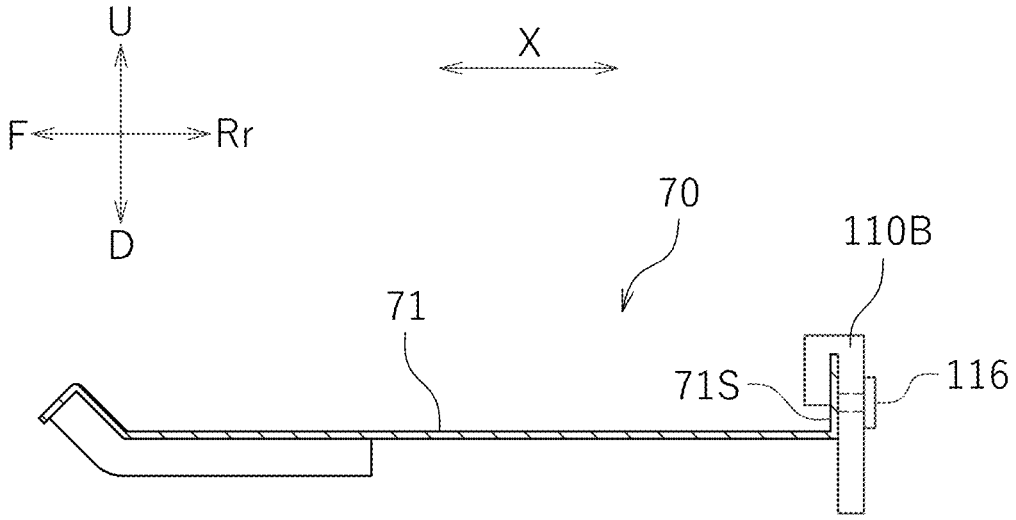
FIG. 28 is a cross-sectional view illustrating a state where a suppression member according to another variation is provided on a plate-shaped member of a downstream light leakage suppression cover.
Figure 29:
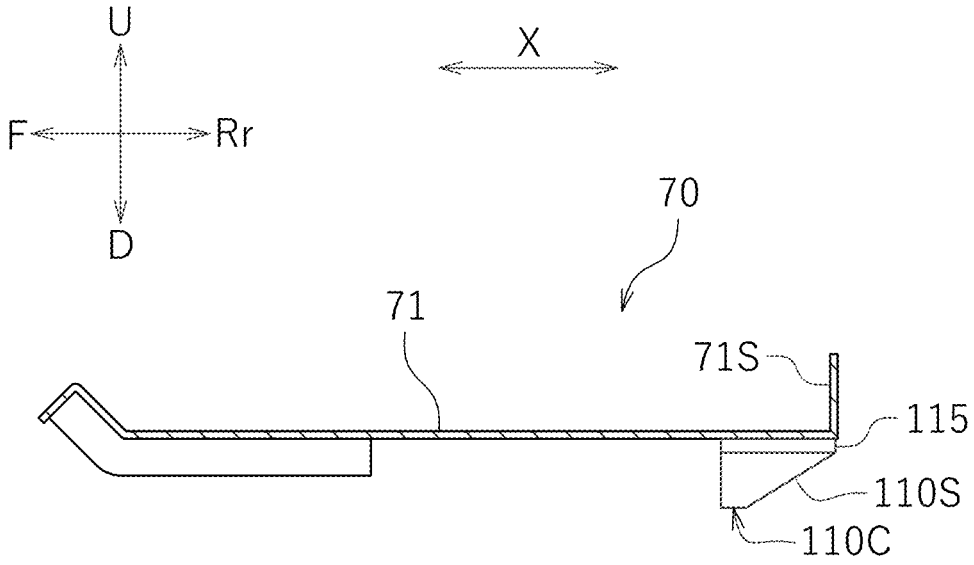
FIG. 29 is a cross-sectional view illustrating a state where a suppression member according to another variation is provided in a plate-shaped member of a downstream light leakage suppression cover.
Figure 30:
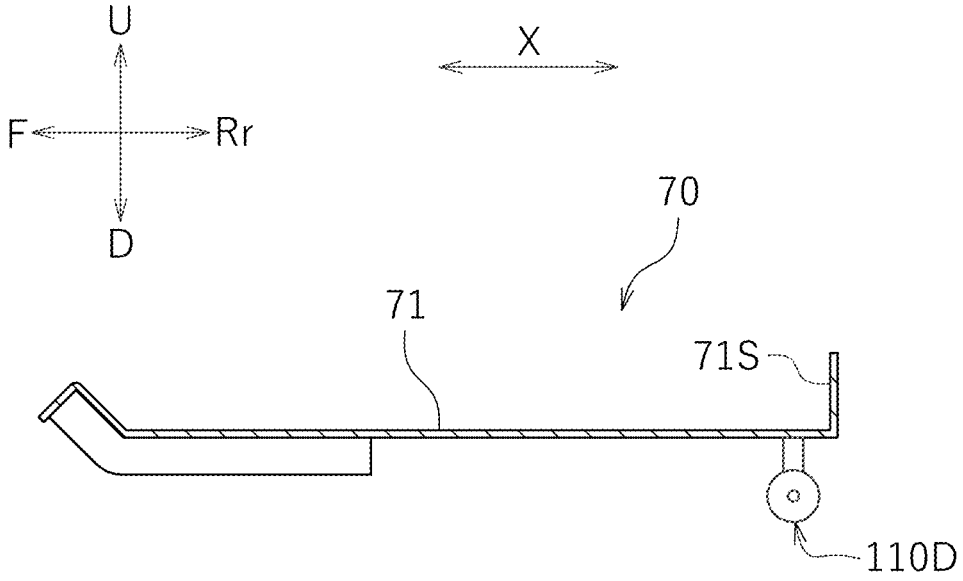
FIG. 30 is a cross-sectional view illustrating a state where a suppression member according to another variation is provided on a plate-shaped member of a downstream light leakage suppression cover.

In the preferred embodiment described above, the suppression member 110 is detachably provided on the back surface of the plate-shaped member 71, but the present teaching is not limited to this example. As illustrated in FIG. 27, the suppression member 110A may be provided on the side wall 71S of the plate-shaped member 71. The suppression member 110A may be attached to the plate-shaped member 71 with the magnet 115 interposed therebetween, for example. By attaching the suppression member 110A to the side wall 71S, the height in the top-bottom direction (i.e., the degree of projection from the plate-shaped member 71) of the suppression member 110A can be changed based on the attachment position by utilizing the length of the side wall 71S in the top-bottom direction. Accordingly, rising of the second recording medium 5B can be effectively suppressed. As illustrated in FIG. 28, the suppression member 110B may be fixed to the side wall 71S of the plate-shaped member 71 with a screw 116. Instead of the screw 116, the suppression member 110B may be fixed to the side wall 71S by a biasing force of a spring (e.g., a state where the suppression member 110B has a clip shape and sandwiches the side wall 71S). The suppression member 110B is also capable of adjusting the height in the top-bottom direction, in a manner similar to the suppression member 110A. As illustrated in FIG. 29, the suppression member 110C may have a slope 110S tilted obliquely downward from the upstream side toward the downstream side in the sub-scanning direction X. The degree of projection of the slope 110S increases from the rear toward the front. Accordingly, the second recording medium 5B is less caught on the suppression member 110C so that the second recording medium 5B can be thereby smoothly conveyed. In addition, as illustrated in FIG. 30, the suppression member 110D may be a rotatable roller. Accordingly, a contact resistance between the suppression member 110D and the second recording medium 5B further decreases, and thus, even when the suppression member 110D and the second recording medium 5B are brought into contact with each other, accuracy in conveying the second recording medium 5B can be maintained high.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink jet printer comprising:

a base member;

a platen disposed on the base member and configured to allow a rolled first recording medium and a sheet-like second recording medium to be placed on the platen;

a carriage disposed on the base member, located above the platen, and movable in a main scanning direction;

an ink head mounted on the carriage and configured to discharge ink onto the first recording medium and the second recording medium, the first recording medium and the second recording medium being conveyed in a sub-scanning direction orthogonal to the main scanning direction; and a guide table detachably disposed on the base member and configured to guide movement of the second recording medium conveyed from the platen, wherein the platen includes a first platen including a flat upper surface and configured such that the first recording medium and the second recording medium are placed on the first platen, and a second platen disposed at a downstream side of the first platen in the sub-scanning direction, including an upper surface tilted obliquely downward from an upstream side in the sub-scanning direction toward the downstream side, and configured to guide movement of the first recording medium, and the guide table includes a placement portion located below the first platen and above a portion of the second platen and including a flat upper surface on which the second recording medium is to be placed.

2. The ink jet printer according to claim 1, wherein the guide table further includes a sloped portion extending to the downstream side from a downstream end of the placement portion in the sub-scanning direction and including an upper surface tilted obliquely downward from the upstream side toward the downstream side in the sub-scanning direction.

3. The ink jet printer according to claim 1, wherein the ink is photocurable ink, the ink jet printer further comprising:

a light irradiator mounted on the carriage and configured to apply light to photocurable ink discharged onto the first recording medium and the second recording medium;

a body case attached to the base member and including an opening, the opening being formed between the body case and the platen and located downstream of the carriage in the sub-scanning direction;

a front cover attached to either the base member or the body case and configured to open and close the opening; and a light leakage suppression cover attached to either the base member or the body case and including a shield, the shield being configured to suppress leakage of light applied from the light irradiator to outside though a gap between the front cover and the platen, and the guide table is disposed below the shield.

4. The ink jet printer according to claim 3, further comprising a support member including a support wall and disposed on the base member, the support wall supporting the light leakage suppression cover, wherein the light leakage suppression cover is configured such that an angle with respect to the front cover is changeable, the support wall includes a first support wall and a second support wall, the first support wall supporting the light leakage suppression cover and tilting downward from the upstream side toward the downstream side in the sub-scanning direction in a case where the first recording medium is conveyed, the second support wall supporting the light leakage suppression cover and extending horizontally in a case where the second recording medium is conveyed.

5. The ink jet printer according to claim 4, wherein the second support wall is configured to support the placement portion of the guide table, and the guide table includes a cover support wall supporting the light leakage suppression cover from below.

6. The ink jet printer according to claim 3, wherein a downstream end of the light leakage suppression cover in the sub-scanning direction is located downstream, in the sub-scanning direction, of a downstream end of the guide table in the sub-scanning direction.

7. The ink jet printer according to claim 3, wherein the light leakage suppression cover includes a suppressor disposed upstream of the shield in the sub-scanning direction and projecting from the shield toward the guide table, and the guide table is disposed below the shield.

8. The ink jet printer according to claim 7, wherein the suppressor is detachably disposed on the shield.

9. The ink jet printer according to claim 7, wherein the suppressor includes a first suppressor and a second suppressor, the first suppressor suppresses rising of one end of the second recording medium in the main scanning direction, and the second suppressor suppresses rising of another end of the second recording medium in the main scanning direction.

10. The ink jet printer according to claim 7, wherein the suppressor includes a slope that tilts obliquely downward from the upstream side toward the downstream side in the sub-scanning direction.

11. The ink jet printer according to claim 7, wherein the suppressor is configured to change an amount of projection from the shield.

12. The ink jet printer according to claim 3, wherein the light leakage suppression cover is configured such that an angle with respect to the front cover is changeable, the shield has a plate shape extending in the main scanning direction, in a case where the first recording medium is placed on the platen, the shield tilts downward from the upstream side toward the downstream side in the sub-scanning direction and overlaps with the platen when seen from the downstream side in the sub-scanning direction, and in a case where the second recording medium is placed on the platen, the shield extends horizontally and is located above the platen.

13. The ink jet printer according to claim 3, wherein the shield has a plate shape extending in the main scanning direction, and in a case where the first recording medium is placed on the platen, the shield is located downstream of the platen in the sub-scanning direction and an upper end of the shield is located above a lower end of the front cover and upstream of the lower end of the front cover in the sub-scanning direction.

14. The ink jet printer according to claim 3, wherein the shield has a plate shape extending in the main scanning direction, and in a case where the second recording medium is placed on the platen, the shield is located above at least a portion of the platen and an upstream end of the shield in the sub-scanning direction is located upstream of a lower end of the front cover in the sub-scanning direction.

15. The ink jet printer according to claim 3, further comprising a detection sensor disposed on the base member and configured to detect whether the light leakage suppression cover is attached or not, wherein the light leakage suppression cover includes a shaft disposed on an end portion of the shield in the main scanning direction and extending in the main scanning direction, and when the shaft comes into contact with the detection sensor, the detection sensor detects that the light leakage suppression cover is attached.

16. The ink jet printer according to claim 15, wherein the base member includes a vertical wall, the vertical wall being disposed on one end portion of the platen in the main scanning direction, extending in a top-bottom direction, and being provided with the detection sensor, the shaft includes a first portion and a second portion, the first portion being connected to the shield, the second portion being connected to the first portion and having a shaft diameter larger than a shaft diameter of the first portion, an upper end of the vertical wall includes a groove, the groove supporting the first portion of the shaft and configured to overlap with a portion of the detection sensor while the shaft is not in contact with the detection sensor when seen in the main scanning direction, and the second portion of the shaft is larger than the groove when seen in the main scanning direction.

17. The ink jet printer according to claim 16, wherein the detection sensor includes a body, a switch disposed on the body and configured to turn on when being pressed, the switch detecting that the light leakage suppression cover is attached, and a pressing plate disposed on the body to be movable in a top-bottom direction, the pressing plate being configured to press the switch when being pressed by the second portion of the shaft from above, and while the second portion of the shaft is not in contact with the pressing plate, the pressing plate overlaps with the groove when seen in the main scanning direction.

* * * * *